US009062492B2

(12) United States Patent
Yu et al.

(10) Patent No.: US 9,062,492 B2
(45) Date of Patent: Jun. 23, 2015

(54) WINDOW SHADE, ITS CONTROL MODULE AND METHOD OF OPERATING THE SAME

(71) Applicants: Fu-Lai Yu, New Taipei (TW); Chin-Tien Huang, New Taipei (TW)

(72) Inventors: Fu-Lai Yu, New Taipei (TW); Chin-Tien Huang, New Taipei (TW)

(73) Assignee: Teh Yor Co., Ltd., Taipei (TW)

( * ) Notice: Subject to any disclaimer, the term of this patent is extended or adjusted under 35 U.S.C. 154(b) by 113 days.

(21) Appl. No.: 13/734,015

(22) Filed: Jan. 4, 2013

(65) Prior Publication Data

US 2013/0340951 A1 Dec. 26, 2013

(30) Foreign Application Priority Data

Jun. 25, 2012 (TW) ..... 101122682 A

(51) Int. Cl.
*E06B 9/304* (2006.01)
*E06B 9/322* (2006.01)

(52) U.S. Cl.
CPC ..... *E06B 9/304* (2013.01); *E06B 9/322* (2013.01)

(58) Field of Classification Search
CPC ..... E06B 9/304; E06B 9/308
USPC ..... 160/168.1 R, 170
See application file for complete search history.

(56) References Cited

U.S. PATENT DOCUMENTS 5,850,863 A * 12/1998 Huang ..... 160/168.1 R
5,904,198 A * 5/1999 Huang ..... 160/168.1 R
6,752,194 B1 * 6/2004 Huang ..... 160/168.1 R
6,786,270 B2 * 9/2004 Wen et al. ..... 160/170
8,356,653 B2 * 1/2013 Fu-Lai et al. ..... 160/84.05
2013/0340951 A1 * 12/2013 YU et al. ..... 160/168.1 P

FOREIGN PATENT DOCUMENTS

| | | |
|---|---|---|
| TW | 525703 | 7/1991 |
| TW | 549349 | 12/1991 |
| TW | I347395 | 12/1996 |
| TW | 421978 U1 | 2/2012 |

* cited by examiner

*Primary Examiner* — Blair M Johnson

(74) *Attorney, Agent, or Firm* — David I. Roche; Baker & McKenzie LLP

(57) ABSTRACT

A window shade comprises a head rail, a plurality of slats, a bottom part, suspension cords connected with cord winding units, and a control module. The control module includes first and second drive axles, a sleeve affixed with the first drive axle, a transmission part connected with the second drive axle, an arrester assembled around the first drive axle, and a release unit including an actuator. The first drive axle is operable to control vertical movement of a bottom part, and the second drive axle is operable to adjust an inclination of the slats. The arrester has a locking state in which it blocks a rotational displacement of the first drive axle to keep the bottom part at a desired position, and an unlocking state allowing rotation of the first drive axle so that the bottom part lowers by gravity action. The actuator has a lengthwise axis, and is operable to move along the lengthwise axis from a first position to a second position to turn the arrester from the locking state to the unlocking state, and the actuator when in the first position can drive the second drive axle in rotation.

20 Claims, 29 Drawing Sheets

WINDOW SHADE, ITS CONTROL MODULE AND METHOD OF OPERATING THE SAME

CROSS-REFERENCE TO RELATED APPLICATION(S)

This application claims priority to Taiwan Patent Application No. 101122682, which was filed on Jun. 25, 2012, the entirety of which is incorporated herein by reference.

BACKGROUND

1. Field of the Invention

The present inventions relate to window shades, and control modules used for actuating the window shades.

2. Description of the Related Art

Many types of window shades are currently available on the market, such as Venetian blinds, roller shades and honeycomb shades. The shade when lowered can cover the area of the window frame, which can reduce the amount of light entering the room through the window and provided increased privacy. Conventionally, the window shade is provided with an operating cord that can be actuated to raise or lower the window shade. In particular, the operating cord may be pulled downward to raise the window shade, and released to lower the window shade.

In a conventional construction of the window shade, the operating cord can be connected with a drive axle. When the operating cord is pulled downward, the drive axle can rotate to wind suspension cords for raising the window shade. When the operating cord is released, the drive axle can be driven to rotate in a reverse direction for lowering the window shade.

However, this conventional construction may require to use an increased length of the operating cord for window shades that have greater vertical lengths. The greater length of the operating cord may affect the outer appearance of the window shade. Moreover, there is the risk of child strangle on the longer operating cord. To reduce the risk of accidental injuries, the operating cord may be maintained at a higher position so that a young child cannot easily reach the operating cord. However, when the operating cord is pulled downward to raise the window shade, the operating cord may still move to a lower position and become accessible for a child.

With respect to a regular user, the manipulation of longer operating cords may also be less convenient. For example, the longer operating cord may become entangled, which may render its operation difficult.

Therefore, there is a need for a window shade that is convenient to operate, safer in use and address at least the foregoing issues.

SUMMARY

The present application describes a window shade, a control module suitable for use with the window shade, and a method of operating the window shade. The construction of the control module can use a shorter length of an operating cord for raising a plurality of slats of the window shade. The control module also includes an actuator that is operable to turn the control module from a locking state to an unlocking state for lowering a bottom part of the window shade, and to adjust an inclination of the slats.

In one embodiment, the control module of the window shade comprises a first drive axle and a second drive axle, a sleeve affixed with the first drive axle, a transmission part connected with the second drive axle, an arrester assembled around the first drive axle, and a release unit including an actuator. The first drive axle is operable to control vertical movement of a bottom part of the window shade, and the second drive axle is operable to adjust an inclination of multiple slats of the window shade. The arrester has a locking state in which the arrester blocks a rotational displacement of the sleeve and the first drive axle to keep the bottom part at a desired position, and an unlocking state in which rotation of the sleeve and the first drive axle is allowed so that the bottom part lowers by gravity action. The actuator is operatively connected with the arrester and has an elongated shape extending substantial vertical that defines a lengthwise axis, wherein the actuator is operable to move along the lengthwise axis from a first position to a second position to turn the arrester from the locking state to the unlocking state, and the actuator when in the first position is operable to drive the second drive axle in rotation via the transmission part.

In another embodiment, a window shade is described. The window shade comprises a head rail, a plurality of slats, a bottom part disposed below the slats, at least one cord winding unit, at least one suspension cord and a ladder cord assembly, and the control module. The cord winding unit includes a housing, and a winding drum and a rotary part respectively assembled pivotally in the housing. The suspension cord is connected with the winding drum and the bottom part, and the ladder cord assembly is respectively connected with the rotary part, the slats and the bottom part. The control module is assembled in the head rail at a location spaced apart from the cord winding unit, the first drive axle of the control module being connected with the winding drum, and the second drive axle of the control module being connected with the rotary part.

The present application also describes a method of operating the window shade. The method comprises pulling the actuator downward from a first position to a second position to turn the arrester from a locking state blocking rotation of the first drive axle to an unlocking state allowing rotation of the first drive axle, whereby the bottom part lowers by gravity action; when the bottom part reaches a desired height, releasing the actuator so that the actuator moves upward to recover the first position; while the actuator is in the first position, rotating the actuator about the lengthwise axis to adjust an inclination of the slats; and pulling on the suspension cord to raise the bottom part.

At least one advantage of the window shades described herein is the ability to conveniently adjust the shade by respectively operating the operating cord and the actuator. The operating cord used for raising the window shade has a shorter length, which can reduce the risk of child strangle. The actuator can be operated according to multiple ways: pulling downward the actuator can lower the window shade, and rotating the actuator about its lengthwise axis can adjust the inclination angle of the slats.

DETAILED DESCRIPTION OF THE EMBODIMENTS

Figure 1:
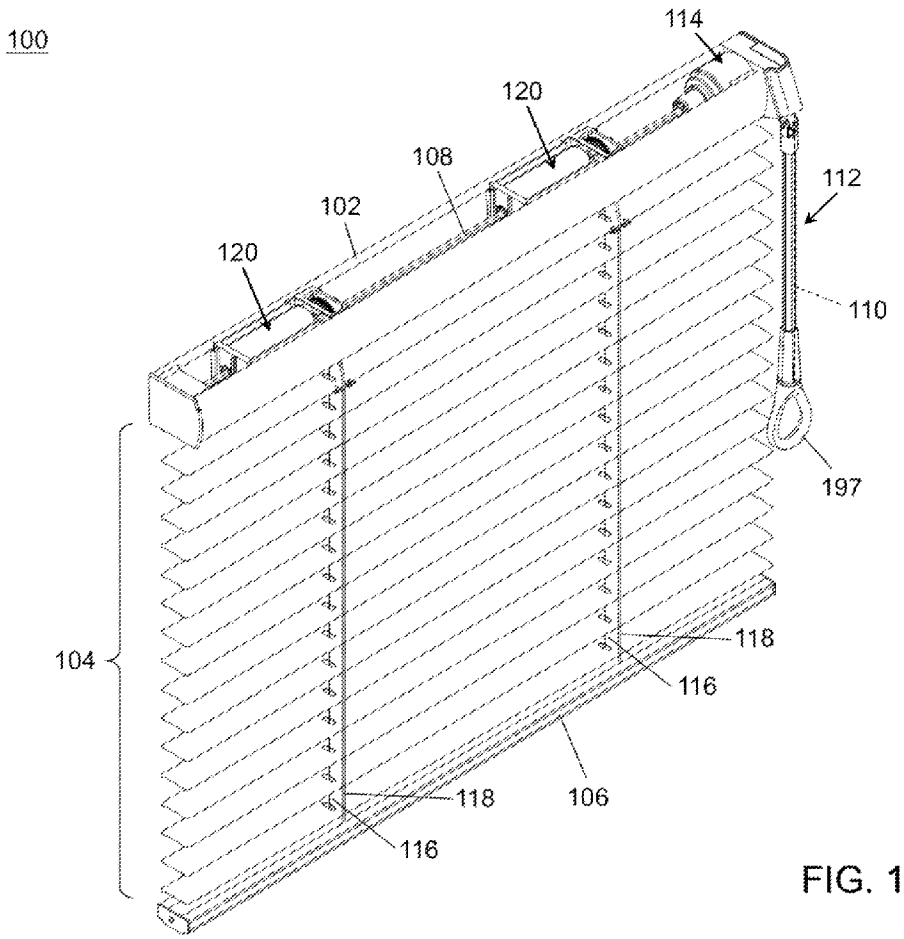
FIG. 1 is a perspective view illustrating an embodiment of a window shade having a control module.
Figure 2:
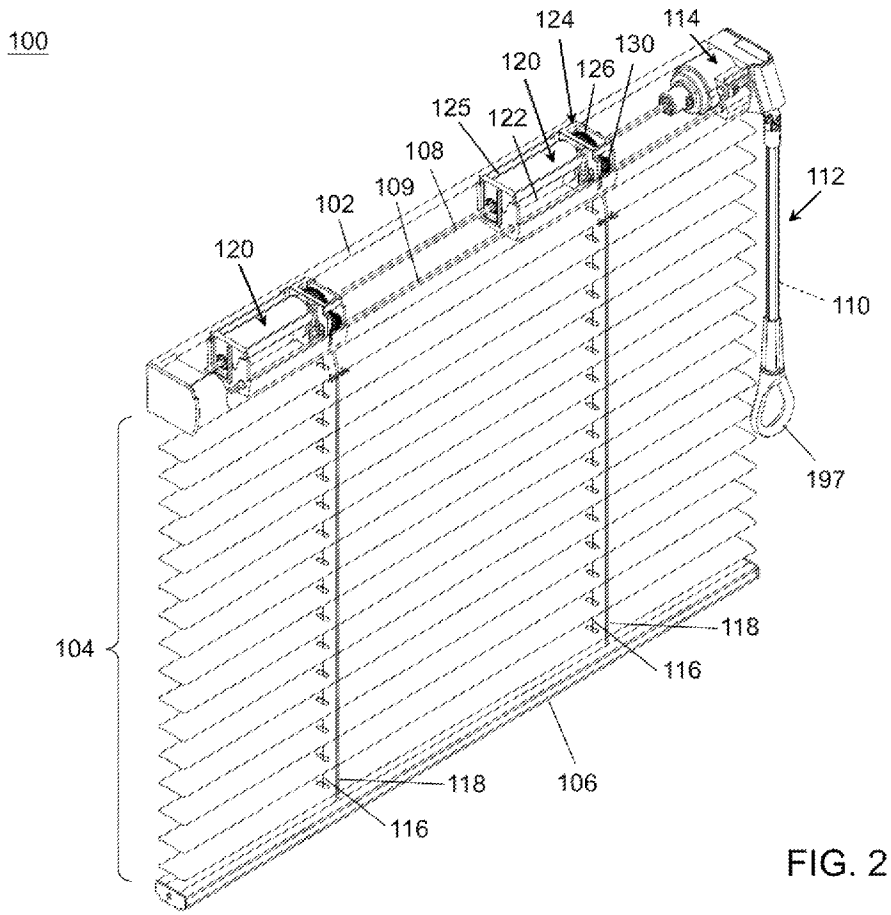
FIG. 2 is a schematic view illustrating an internal construction of the window shade shown in FIG. 1.

FIG. 1 is a perspective view illustrating an embodiment of a window shade 100, and FIG. 2 is a schematic view illustrating an internal construction of the window shade 100. The window shade 100 can include a head rail 102, a shading structure comprised of a plurality of slats 104, and a bottom part 106 disposed at a bottom of the set of slats 104. For operatively actuating the slats 104 and the bottom part 106, the window shade 100 can include a control module 114, a plurality of suspension cords 116, multiple sets of ladder cord assembly 118 and one or more cord winding units 120. The control module 114 can include two drive axles 108 and 109, an operating cord 110 (shown with phantom line) and an actuator 112.

Each suspension cord 116 can be disposed between the head rail 102 and the bottom part 106, and have a first end connected with a winding drum 122 of one associated winding unit 120, and a second end connected with the bottom part 106. The bottom part 106 can move upward toward the head rail 102 to gather the slats 104 compactly between the bottom part 106 and the head rail 102. For raising the bottom part 106, the operating cord 110 can be pulled downward so as to actuate the control module 114 and cause the drive axle 108 to rotate, which in turn drives the winding drum 122 of each winding unit 120 to rotate for winding the associated suspension cord 116.

Each ladder cord assembly 118 can include two cord segments respectively disposed adjacent to the rear and front edges of the slats 104. Each ladder cord assembly 118 can have an upper end connected with a rotary part 124, can extend vertically between the head rail 102 and the bottom part 106, and can connect with the rear and front edges of each slat 104. In addition, each ladder cord assembly 118 can have a lower end connected with rear and front edges of the bottom part 106. The ladder cord assemblies 118 can be displaced up and down to adjust an inclination of the slats 104 relative to a horizontal or vertical plane, which can open and close the gaps between the slats 104 to control the amount of light passing through the slats 104. For controlling the vertical displacement of the ladder cord assemblies 118, the rotary part 124 of the winding unit 120 can be connected with the drive axle 109, and the drive axle 109 can be operatively coupled with the actuator 112 via the control module 114. Accordingly, a rotation of the actuator 112 can drive vertical displacement of the ladder cord assemblies 118 via the drive axle 109.

In addition, the actuator 112 can also be operated to turn the control module 114 to an unlocking or release state in which the drive axle 108 is allowed to rotate. When the control module 114 is in this release state, the bottom part 106 can self lower by gravity action, which causes the suspension cords 116 to unwind from their respective cord winding units 120 and the slats 104 to expand. Moreover, the control module 114 can convert a rotational displacement of the actuator 112 into a rotation of the drive axle 109, which in turn can drive the rotary part 124 in rotation to cause vertical displacement of the associated ladder cord assembly 118. Exemplary constructions and operations of the control module 114 will be described hereafter with reference to additional drawings.

Various constructions may be applicable for the slats 104. For example, the slats 104 may include fabric materials, rigid slats, etc.

The head rail 102 may be of any types and shapes. The head rail 102 may be disposed at a top of the window shade 100, and can be configured to receive the drive axle 108 and the control module 114. The bottom part 106 can be disposed at a bottom of the window shade 100. In one embodiment, the bottom part 106 may be formed as an elongated rail. However, any types of weighing structures may be suitable. In some embodiment, the bottom part 106 may also be formed by a lowermost one of the slats 104.

The drive axle 108 can define a first drive axis, and can be respectively connected with the cord winding units 120 and the control module 114. The vertical displacement of the bottom part 106 can be coupled with rotational movement of the drive axle 108. In one embodiment, the winding drum 122 of each cord winding unit 120 can be affixed with the drive axle 108, so that the drive axle 108 and the winding drums 122 can rotate in unison for winding and unwinding the suspension cords 116. Moreover, the drive axle 108 is connected with the control module 114, and the drive axle 108 can also be driven in rotation by manually actuating the operating cord 110 to raise the slats 104.

The construction of the window shade 100 can be such that a user can pull on the operating cord 110 to raise the bottom part 106 and stack the slats 104 upward. In one embodiment, the operating cord 110 can have a length that is shorter than a permitted total course of the bottom part 106. The user can repeatedly apply a sequence of pulling and release actions on the operating cord 110 to progressively raise the bottom part 106 and stack the slats 104 upward. For example, the overall length of the operating cord 110 can be smaller than half the height of the totally expanded slats 104. In another example, the length of the operating cord 110 can be one third of the height of the totally expanded slats 104, and the operating cord 110 can be repeatedly pulled about three times to entirely raise the slats 104. This process is similar to a ratcheting technique allowing the user to pull the operating cord 110 to raise the slats 104 a certain amount, allow the operating cord 110 to retract, and then pull the operating cord 110 again to continue to raise the slats 104. This process may be repeated until the slats 104 reach a desired height.

Moreover, the actuator 112 can be operatively rotated to turn the control module 114 from a locking state to a release state to allow rotation of the drive axle 108, such that the bottom part 106 can lower by action of its own weight. When the actuator 112 is released, the control module 114 can turn from the release state to the locking state to block rotation of the drive axle 108.

The drive axle 109 can define a second drive axis that is parallel to the drive axle 108, and can be respectively connected with the rotary part 124 of each cord winding unit 120 and the control module 114. The actuator 112 can be operable to drive the drive axle 109 in rotation independently from the drive axle 108 to cause a rotational displacement of the rotary part 124.

Figure 3:
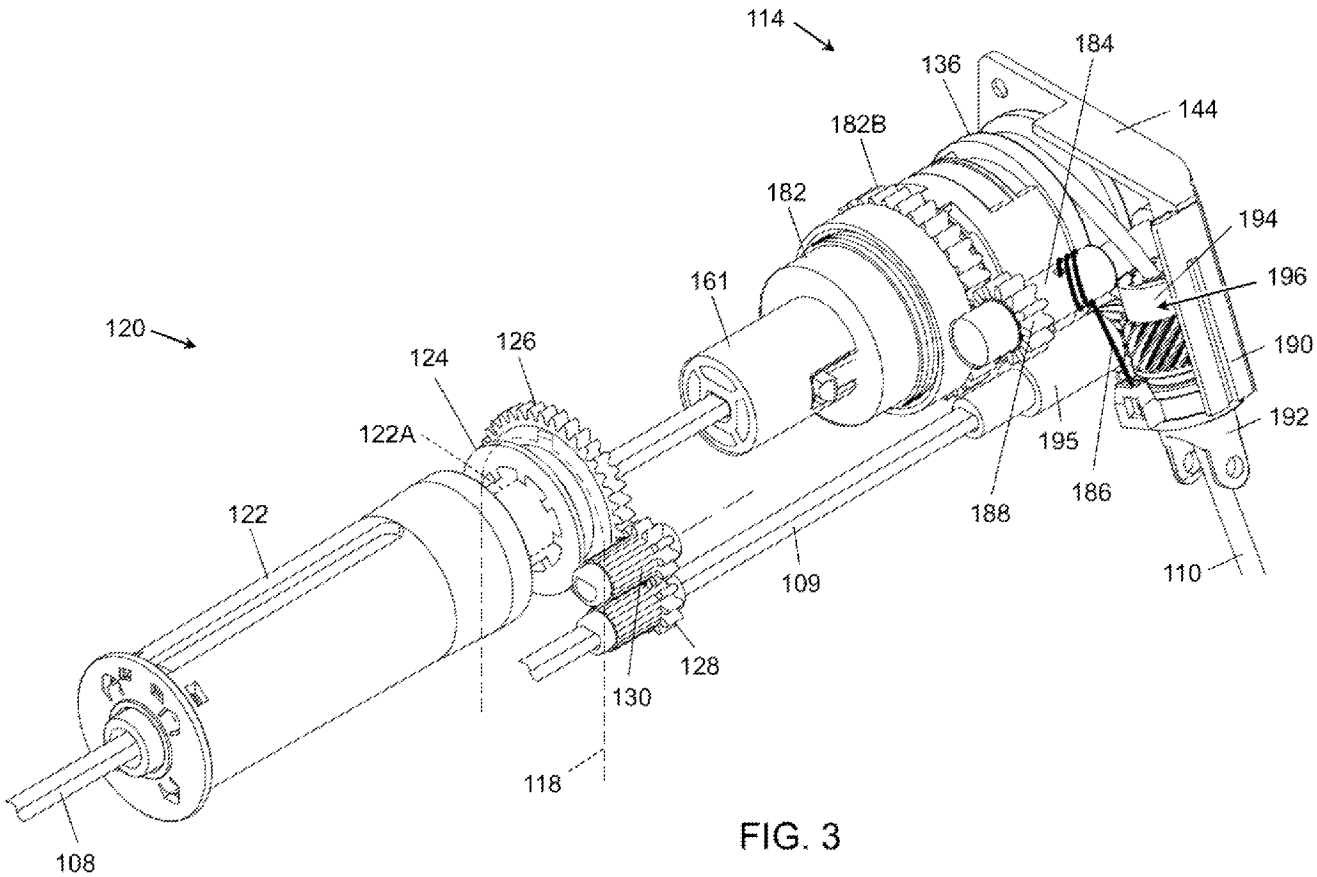
FIG. 3 is a perspective view illustrating the assembly of a control module, a cord winding unit and two drive axles in the window shade.

In conjunction with FIG. 2, FIG. 3 is a perspective view illustrating the assembly of the control module 114, one cord winding unit 120 and the drive axles 108 and 109. The cord winding unit 120 can be disposed spaced apart from the control module 114. The cord winding unit 120 can include the winding drum 122, the rotary part 124, and a housing 125 (better shown in FIG. 2). The winding drum 122 and the rotary part 124 can be respectively connected pivotally in the housing 125. In some embodiments, the winding drum 122 can have a shaft 122A (shown with phantom lines) extending from a side thereof, and the rotary part 124 can be pivotally assembled around the shaft 122A.

The drive axle 108 can be assembled with the control module 114, and respectively pass through the winding drum 122 and the rotary part 124 of the cord winding unit 120. The drive axle 108 can be affixed with the winding drum 122, so that the drive axle 108 and the winding drum 122 can rotate in unison to wind and unwind the suspension cord 116. The rotary part 124 may be a pulley that is assembled coaxial relative to the drive axle 108, but is not rotationally locked with the drive axle 108. Accordingly, the rotary part 124 can rotate independently relative to the drive axle 108 and the winding drum 122.

The drive axle 109 can be assembled with the control module 114, and extend parallel to the drive axle 108 along the head rail 102. The rotary part 124 can include a gear 126 affixed therewith that is arranged coaxial around the drive axle 108. The ladder cord assembly 118 can wrap in contact around the rotary part 124, so that rotation of the rotary part 124 can drive a vertical displacement of the ladder cord assembly 118. A gear 128 can be assembled around the drive axle 109 at a location adjacent to the gear 126. The gears 126 and 128 can respectively engage with an intermediate gear 130, so that the drive axle 109 can drive the rotary part 124 to rotate relative to the winding drum 122 and the drive axle 108. For facilitating assembly, the gear 128 and the intermediate gear 130 can be pivotally assembled in the housing 125 of the cord winding unit 120. Moreover, the gear 128 can have a central hole that is not circular, and the drive axle 109 can pass through the central hole of the gear 128 to make the drive axle 109 and the gear 128 rotationally locked with each other.

Figure 4:
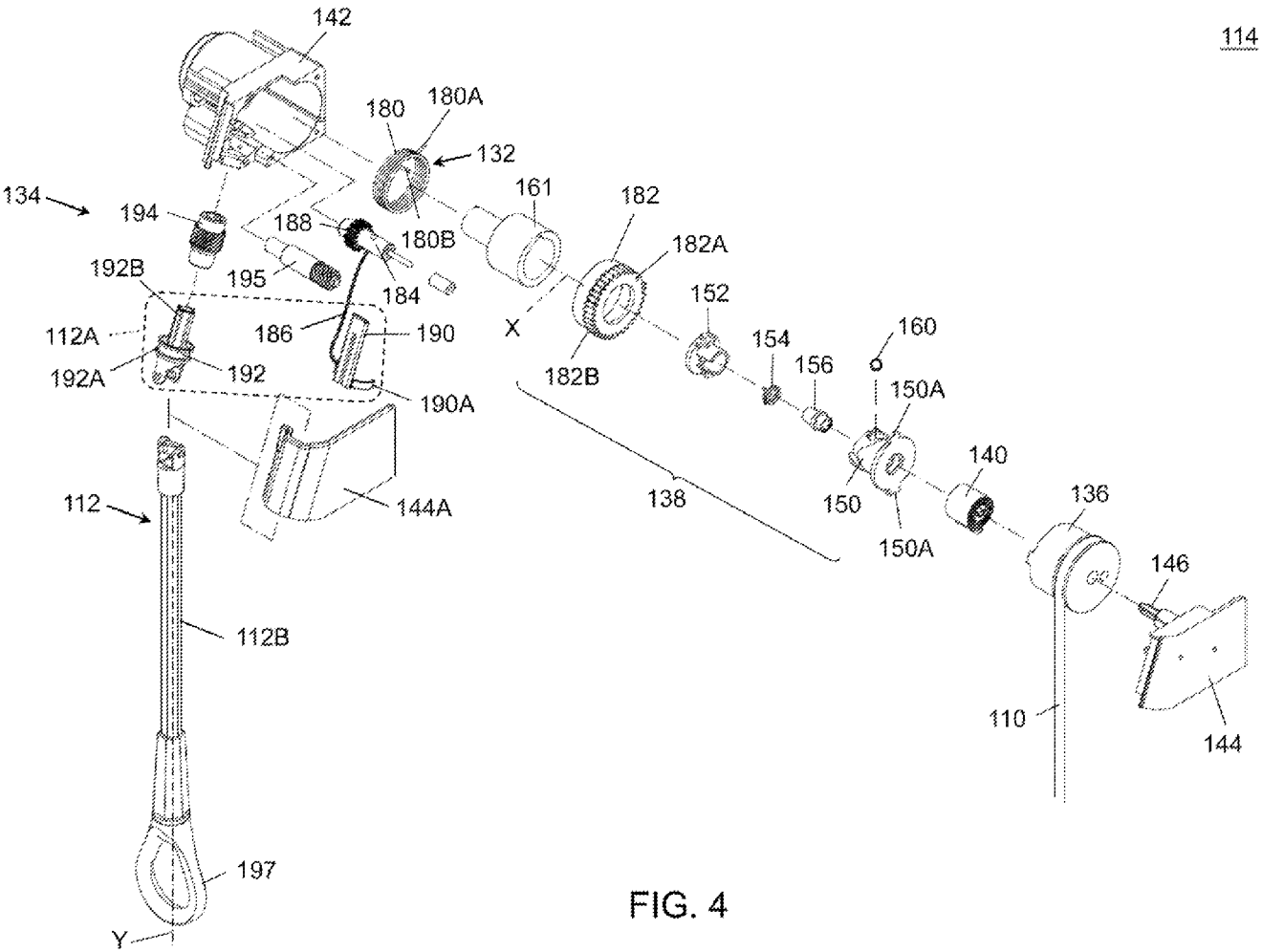
FIG. 4 is an exploded view illustrating the control module.
Figure 5:
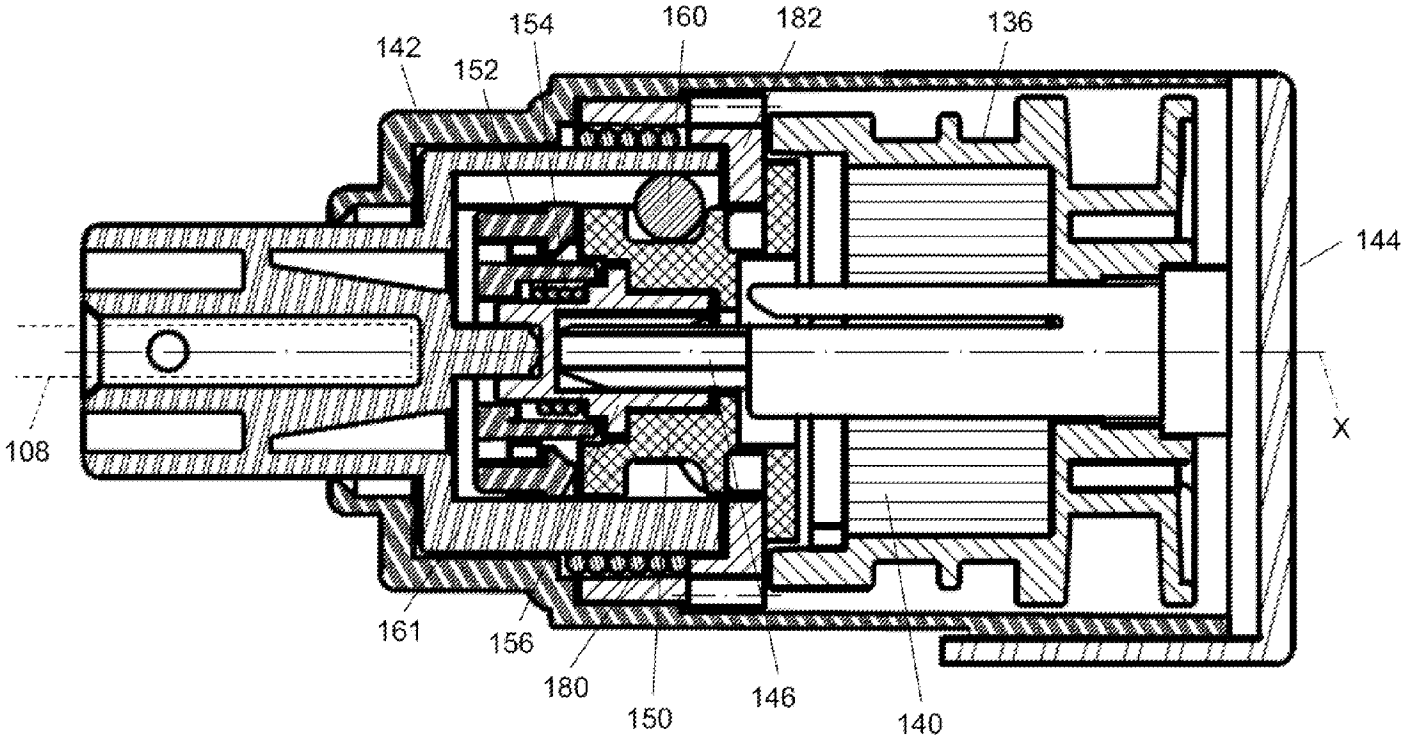
FIG. 5 is a cross-sectional view illustrating the control module.

FIGS. 4 and 5 are respectively exploded and cross-sectional views illustrating an embodiment of the control module 114. The control module 114 can include an arrester 132, a release unit 134, a cord drum 136 and a clutch 138. The control module 114 can further include a spring 140 operable to drive rotation of the cord drum 136 in a direction for winding the operating cord 110. The spring 140 can be disposed inside (as shown) or outside the control module 114.

In addition, the control module 114 can include a housing 142 and a cover 144. The housing 142 and the cover 144 can be assembled together to form an enclosure in which the component parts of the control module 114 can be assembled.

The clutch 138 can be operable to couple and decouple the movement of the cord drum 136 with respect to the drive axle 108. When the clutch 138 is in the decoupling state, the drive axle 108 and the cord drum 136 can rotate relative to each other. For example, the cord drum 136 can remain stationary, and the weight of the bottom part 106 and slats 104 stacked thereon can drive the drive axle 108 in rotation relative to the cord drum 136, which causes the bottom part 106 to lower and the slats 104 to expand. Alternatively, the drive axle 108 can remain stationary, and the cord drum 136 can rotate to wind and take up the operating cord 110. By pulling the operating cord 110 downward, the clutch 138 can be turned to the coupling state. In the coupling state of the clutch 138, the cord drum 136 and the drive axle 108 can rotate in unison via movement transmission through the clutch 138 to raise the bottom part 106 and stack the slats 104 upward.

The clutch 138 can be assembled about a fixed shaft 146 between the arrester 132 and the cord drum 136. In one embodiment, the clutch 138 can include a first coupling 150, a second coupling 152, a spring 154, a connection member 156 and a rolling part 160. The rolling part 160 can be exemplary a ball. The clutch 138 can further include a sleeve 161.

Figure 6:
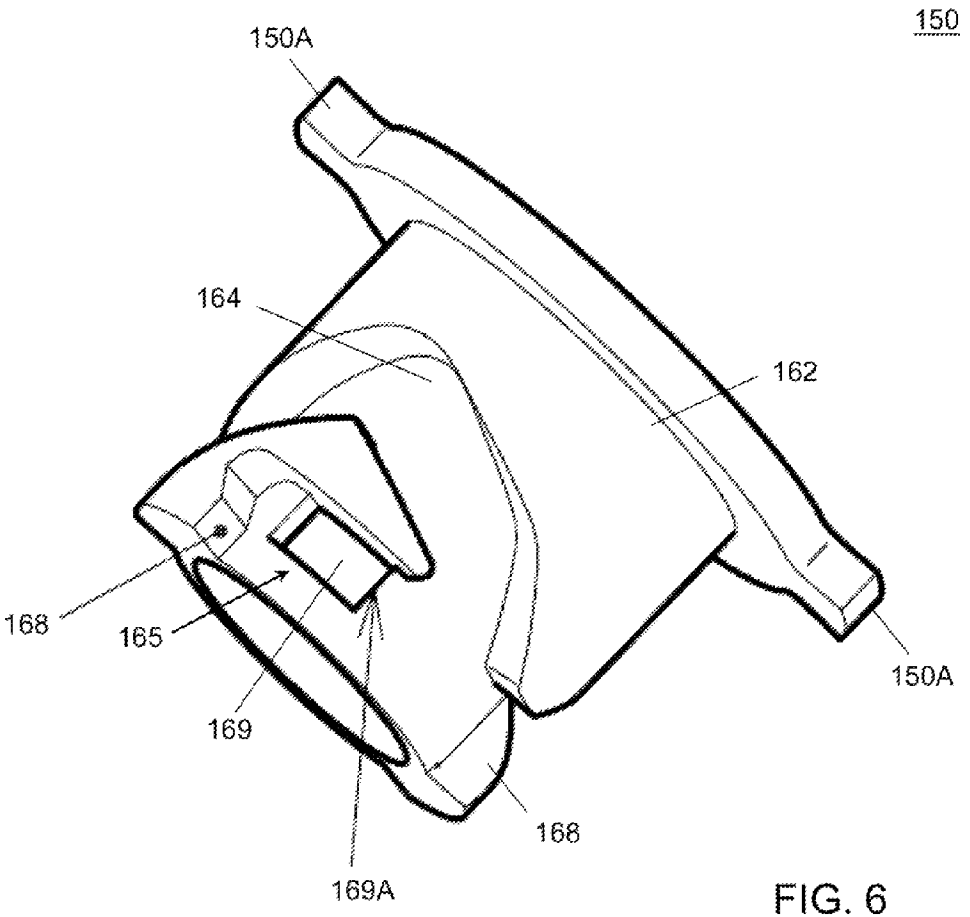
FIG. 6 is a perspective view illustrating a first coupling of a clutch used in the control module.
Figure 7:
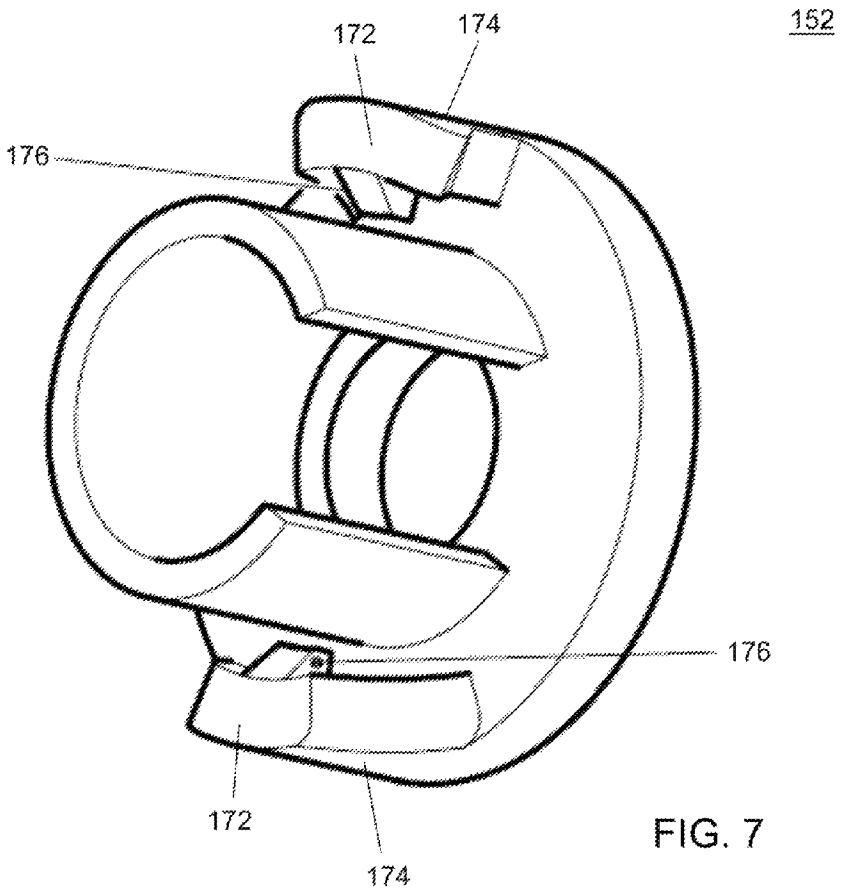
FIG. 7 is a perspective view illustrating a second coupling of a clutch used in the control module.
Figure 8:
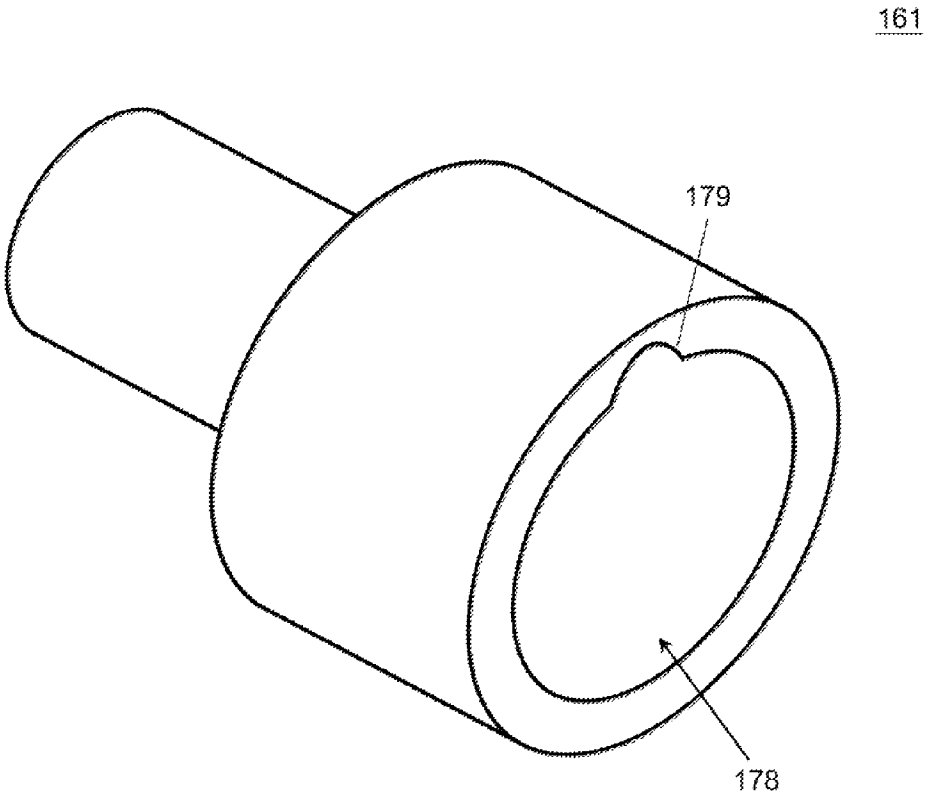
FIG. 8 is a perspective view illustrating a sleeve affixed with a first drive axle in the control module.
Figure 9:
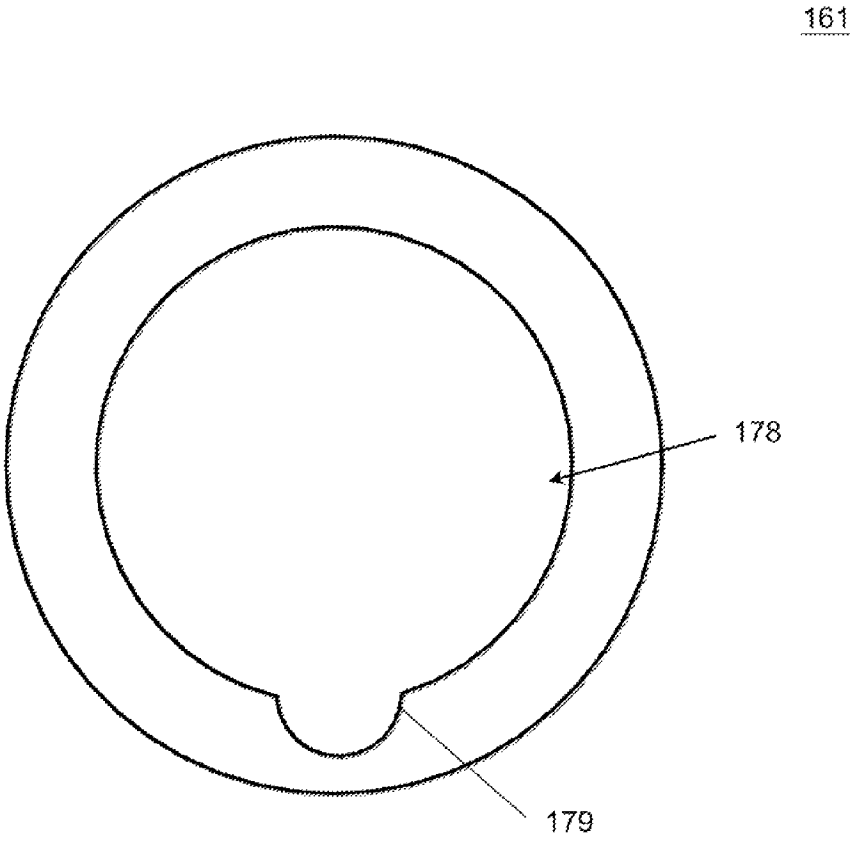
FIG. 9 is a front view of the sleeve shown in FIG. 8.

Referring to FIGS. 5-7, the connection member 156 can be affixed with the fixed shaft 146. The fixed shaft 146 can be spaced apart from the drive axle 108. More specifically, the fixed shaft 146 can extend from the cover 144 coaxial to the drive axle 108. The first coupling 150 can be pivotally connected with a portion of the fixed shaft 146, and the second coupling 152 can be pivotally connected with the connection member 156. The first and second couplings 150 and 152 can rotate about the common axis defined along the drive axle 108 and the fixed shaft 146 relative to the fixed shaft 146 to turn the clutch 138 to the coupling or the decoupling state.

Referring to FIG. 6, the first coupling 150 can have a generally cylindrical shape, and mate with the second coupling 152. More particularly, the first coupling 150 can have an outer surface 162 of a cylindrical shape defined between two end portions. The outer surface 162 can include a recessed region that extends along the periphery of the first coupling 150 and at least partially defines a guide track 164 of the clutch 138, and one or more notch 165 communicating with the guide track 164. In one embodiment, two notches 165 may be provided diametrically opposite to each other. The first coupling 150 can have a first end portion near the cord drum 136 provided with two opposite radial flanges 150A. The cord drum 136 can contact with the radial flanges 150A, such that rotation of the cord drum 136 can drive the first coupling 150 to rotate.

The first coupling 150 can have a second end portion near the second coupling 152 provided with at least a radial abutment 168 that is located adjacent to the notch 165. In one embodiment, two radial abutments 168 can be provided at two opposite locations on the outer surface of the first coupling 150 respectively adjacent to the notches 165.

The first coupling 150 can further include at least a slot 169 spaced apart from the radial abutments 168. In one embodiment, two slots 169 can be provided at diametrically opposite locations of the first coupling 150 respectively adjacent to the radial abutments 168.

Referring to FIG. 7, the second coupling 152 can have a generally cylindrical shape, and can mate with the first coupling 150. The second coupling 152 can have two radial ribs 172 diametrically opposite to each other. Each radial rib 172 can have an outer surface 174 and an extension 176. The extension 176 can project radial from the radial rib 172 toward the center of the second coupling 152.

Figure 17:
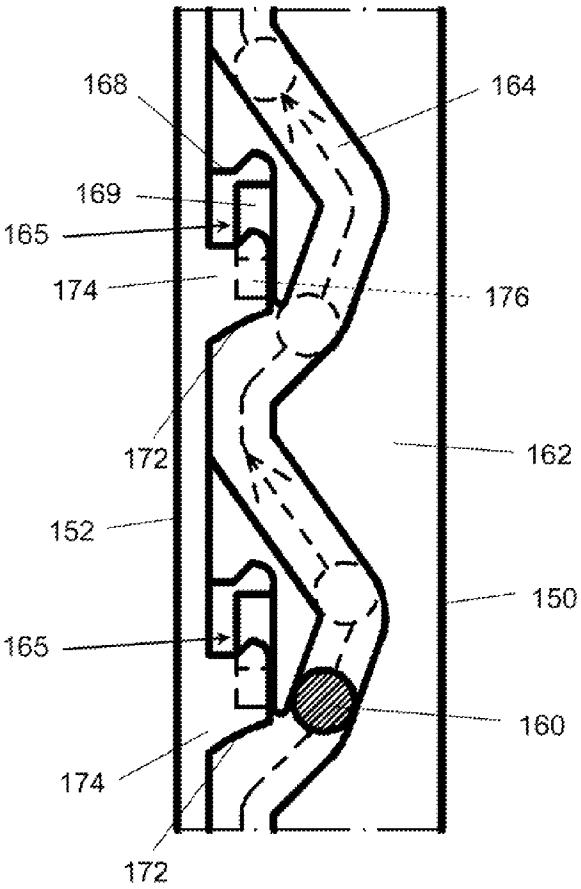
FIG. 17 is a schematic view illustrating a configuration of a guide track provided in the clutch when the window shade is lowered.

As shown in FIG. 17, after the first and second couplings 150 and 152 are assembled together, a closed guide track 164 can be formed between the outer surface 162 of the first coupling 150 and the outer surface 174 of the second coupling 152. The guide track 164 can peripherally run around the first and second couplings 150 and 152. Each radial rib 172 can be movably disposed adjacent to one corresponding notch 165 of the first coupling 150. The extension 176 can detachably insert into one corresponding slot 169 to guide relative movement between the first and second couplings 150 and 152. Accordingly, the radial ribs 172 can move respectively in the notches 165 to form or remove a plurality of stop regions 177 in the path of the guide track 164 (as better shown in FIGS. 24 and 25).

In conjunction with FIGS. 4 and 5, FIGS. 8 and 9 are schematic views illustrating the sleeve 161. The sleeve 161 can be generally cylindrical in shape, and can be affixed with the drive axle 108, such that the sleeve 161 can rotate along with the drive axle 108. The sleeve 161 can include a central cavity 178 and a radial slot 179. The radial slot 179 can be formed in an inner sidewall of the central cavity 178, and can extend linearly parallel to the axis of the drive axle 108. When the clutch 138 is assembled, the first and second couplings 150 and 152 can be disposed in the central cavity 178, such that the guide track 164 can overlap at least partially with the length of the radial slot 179, and the rolling part 160 can be disposed in the guide track 164 and the radial slot 179.

When the clutch 138 is in the decoupling state, the relative positions of the first and second couplings 150 and 152 can be such that a rotation of the drive axle 108 and the sleeve 161 independent from the cord drum 136 can cause the rolling part 160 to move along the radial slot 179 and the guide track 164 relative to the couplings 150 and 152 and the sleeve 161.

Figure 24:
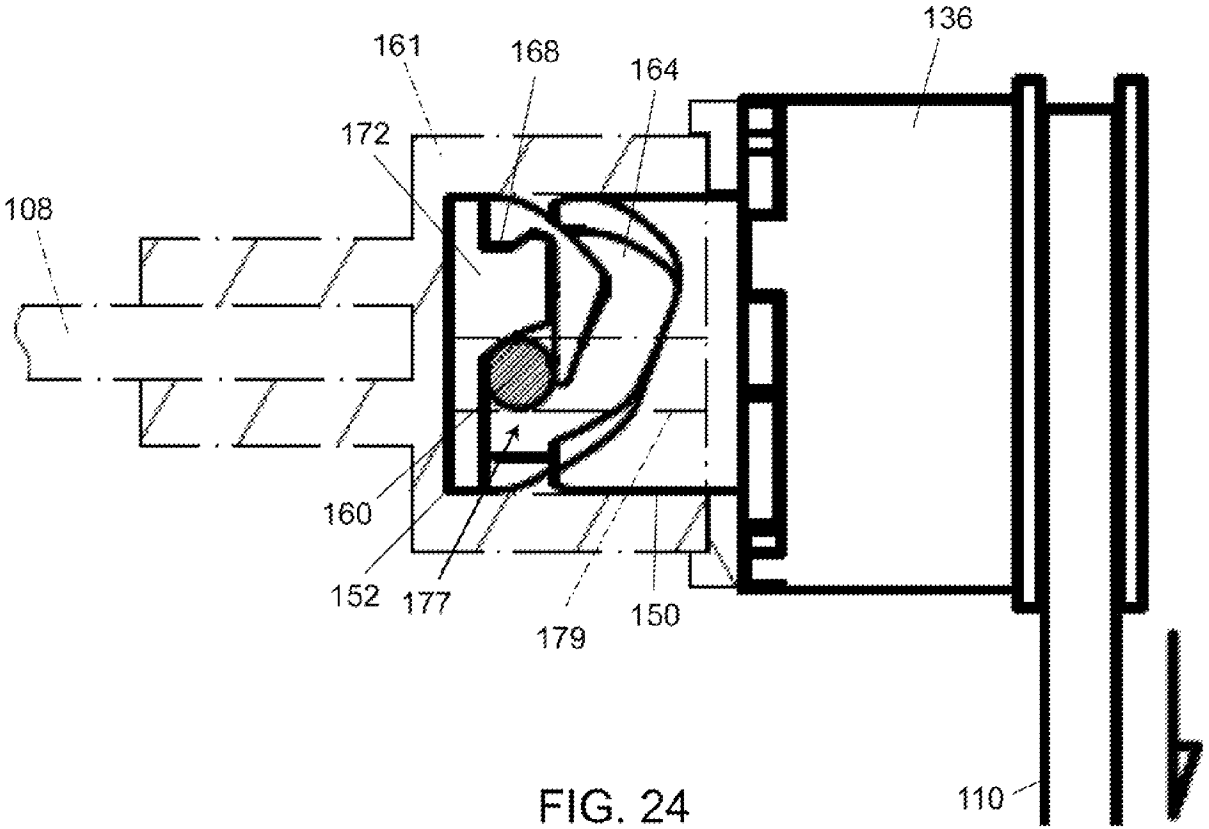
FIG. 24 is a schematic view illustrating a portion of the control module during raising of the window shade.
Figure 25:
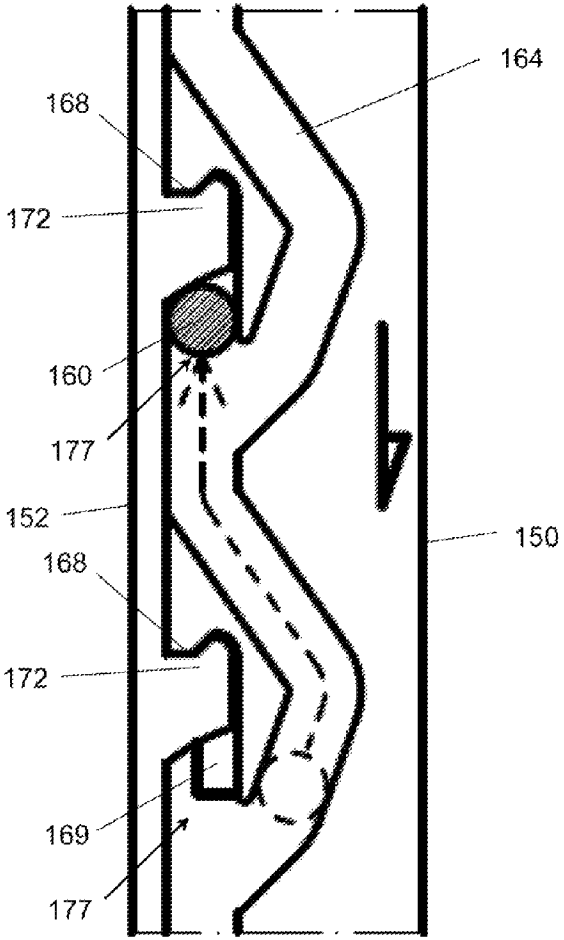
FIG. 25 is a schematic view illustrating a configuration of a guide track provided in the clutch when the window shade is raised.

When the clutch 138 is in the coupling state, the second coupling 152 can rotationally displace to a second position relative to the first coupling 150 so as to form the stop regions 177 of recessed shapes in the guide track 164. The stop regions 177 can be respectively formed as recesses at the areas of the notches 165, delimited by at least one sidewall of the guide track 164 (as shown in FIG. 24). Accordingly, the rolling part 160 can move along the guide track 164 and the radial slot 179, and then enter and stop in one stop region 177. As a result, the rotation of the cord drum 136 can be transferred via the first and second couplings 150 and 152 and through the restricted rolling part 160 to the sleeve 161 and the drive axle 108. In some variant embodiments, the clutch 138 can also directly transfer the rotation from the cord drum 136 to the drive axle 108.

Figure 10:
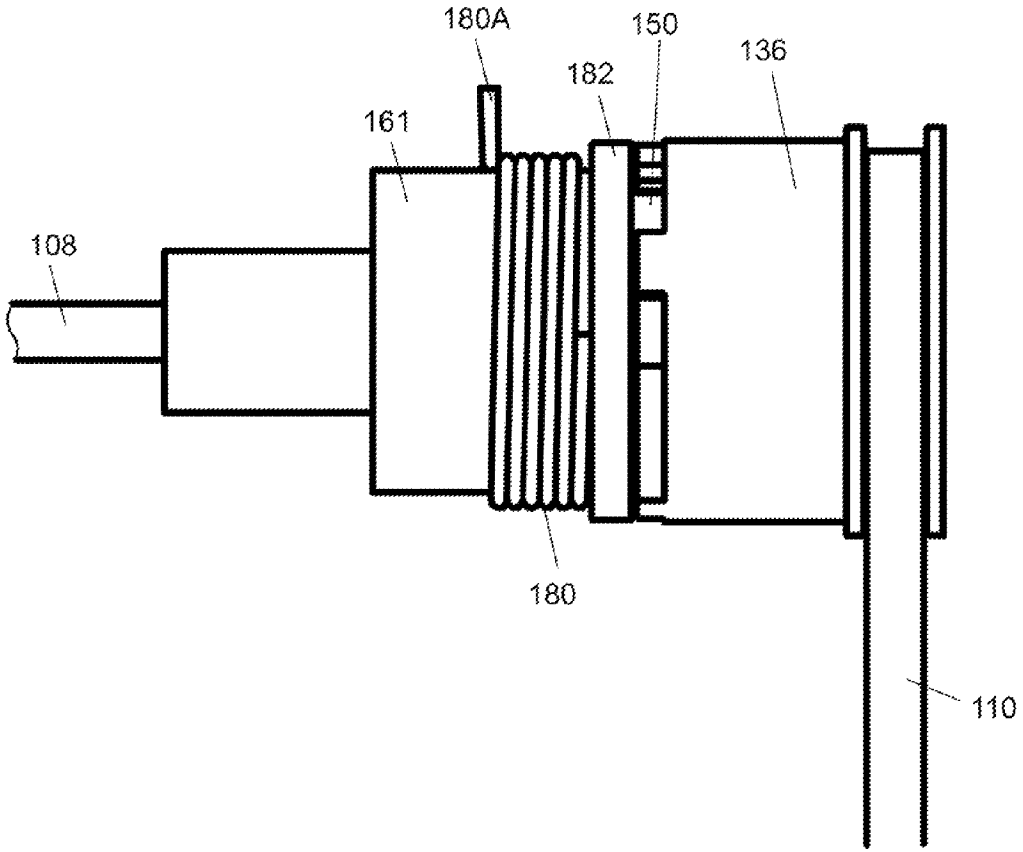
FIG. 10 is a side view illustrating an assembled portion of the control module.
Figure 11:
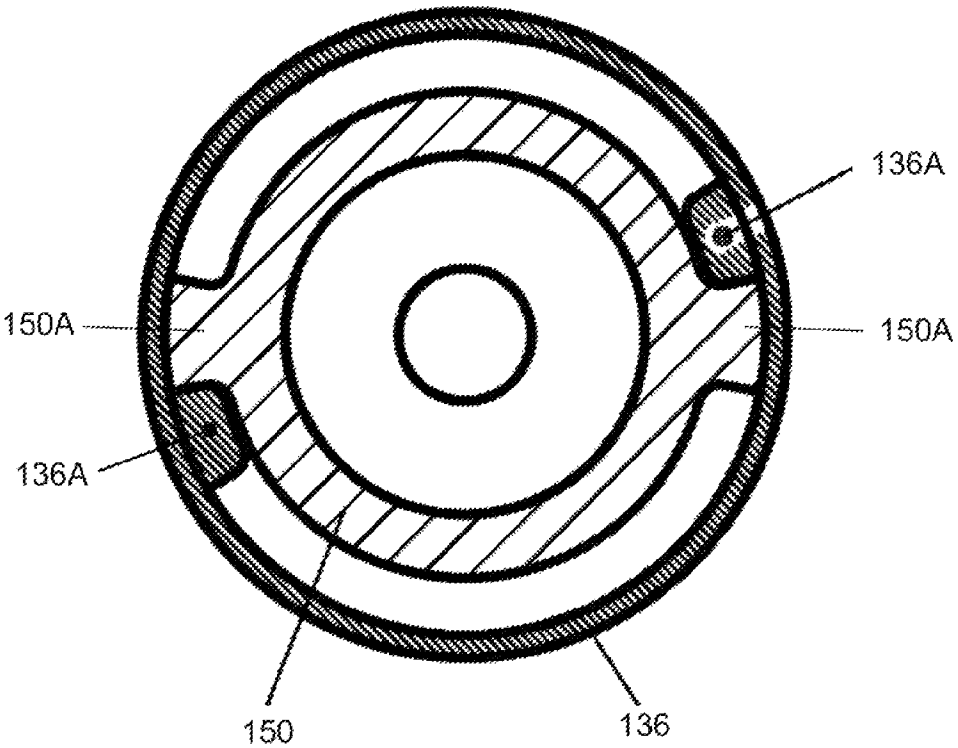
FIG. 11 is a side view illustrating a cord drum in the control module.

In conjunction with FIG. 4, FIGS. 10 and 11 are schematic views illustrating the assembly of a portion of the control module 114 (including the cord drum 136 and the sleeve 161). The cord drum 136 can have a generally cylindrical shape. The cord drum 136 can be pivotally connected with the fixed shaft 146, and can be disposed adjacent to a side of the first coupling 150 opposite to the second coupling 152. The cord drum 136 can be connected with the operating cord 110, such that a rotation of the cord drum 136 can wind the operating cord 110 thereon. An end portion of the cord drum 136 proximate to the first coupling 150 can have at least one radial flange 136A. The radial flange 136A can contact with the flange 150A of the first coupling 150 so as to drive rotation of the clutch 138.

Referring to FIGS. 4 and 5, the cord drum 136 can be coupled with the spring 140. The spring 140 can bias the cord drum 136 in rotation for winding the operating cord 110 around the cord drum 136. The spring 140 can be exemplary a torsion spring assembled in an inner cavity of the cord drum 136. The torsion spring can have a first end affixed with the fixed shaft 146, and a second end affixed with the cord drum 136. The cord drum 136 can be driven by the biasing action of the torsion spring to rotate relative to the fixed shaft 146 for winding the operating cord 110.

Figure 12:
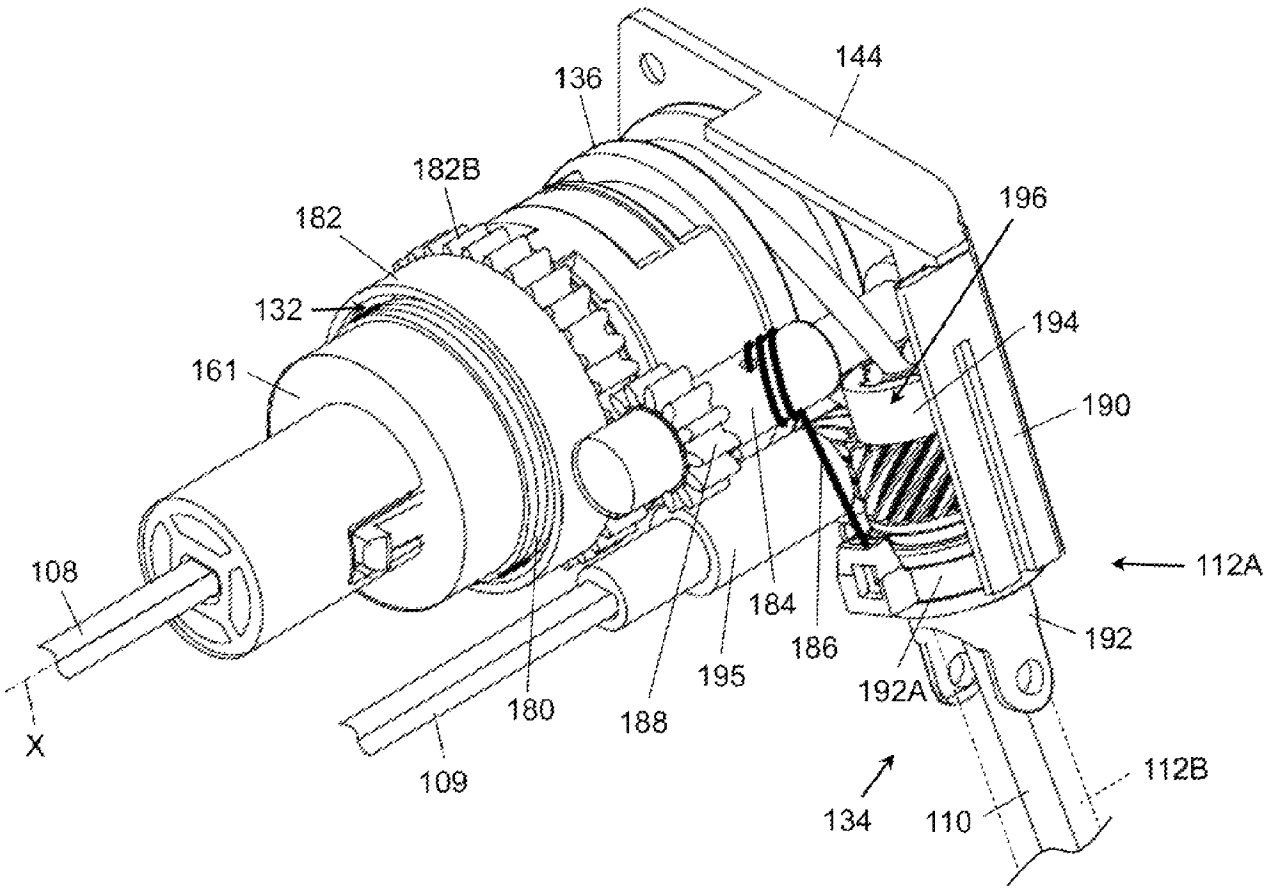
FIG. 12 is a perspective view illustrating the assembly of an arrester and a release unit in the control module.
Figure 13:
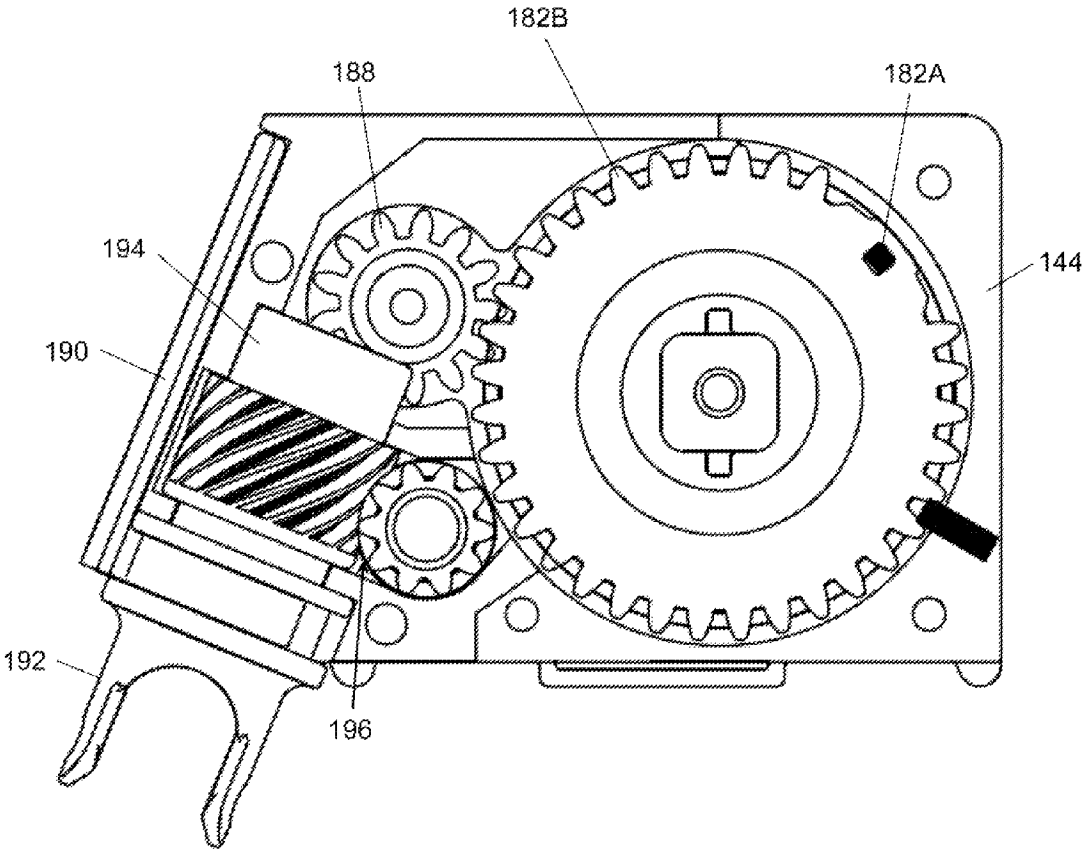
FIG. 13 is a side view illustrating the assembly of the arrester and the release unit in the control module.

In conjunction with FIG. 3, FIGS. 12 and 13 are schematic views illustrating the assembly of the arrester 132 and the release unit 134. The arrester 132 can be assembled around the drive axle 108, and can rotate relative to the rotation axis X of the drive axle 108. The arrester 132 can have a locking state and an unlocking or release state. In the locking state, the arrester 132 can tighten on the sleeve 161 to lock the sleeve 161 and the drive axle 108 in position. Rotation of the sleeve 161 and drive axle 108 can be thereby blocked, and the slats 104 and the bottom part 106 can be held at a desired position. In the unlocking or release state, the arrester 132 can relax and allow rotation of the sleeve 161 and drive axle 108 so that the slats 104 and the bottom part 106 can lower by gravity action. In one embodiment, the arrester 132 can include a spring 180, e.g., a wrapping spring. The spring 180 can have a cylindrical shape, and can wrap on a peripheral surface of the sleeve 161. The spring 180 can include first and second prongs 180A and 180B extending radial outward. The first prong 180A can be affixed with the housing 142, and the second prong 180B can be affixed with a collar 182. The spring 180 can tighten on the sleeve 161 in the locking state, and loosen in the unlocking state.

The release unit 134 can be connected with the arrester 132, and can be operable to drive the arrester 132 to switch from the locking state to the unlocking state. In one embodiment, the release unit 134 can include a collar 182, a transmission part 184, an elongated drawing member 186, and the actuator 112. The collar 182 can have a circular shape. However, other shapes may be suitable, e.g., a semicircular shape, a curved shape, and the like. The collar 182 can be pivotally connected between the sleeve 161 and the cord drum 136, more particularly between the sleeve 161 and the first coupling 150. The collar 182 can rotate about the rotation axis X of the drive axle 108. The collar 182 can also include a hole 182A eccentric from the rotation axis X, and a gear portion 182B that can mount around the rotation axis X. The second prong 180B of the spring 180 can engage through the hole 182A to affix with the collar 182.

The transmission part 184 is a rotatable transmission part that can be disposed between the collar 182 and the actuator 112. In one embodiment, the transmission part 184 can be pivotally assembled with the housing 142 or the cover 144. The pivot axis of the transmission part 184 can be substantially parallel to the drive axle 108. A first side portion of the transmission part 184 can include a gear portion 188 that can engage with the gear portion 182B of the collar 182. A second portion of the transmission part 184 can have a cylindrical shape that affixed with the gear portion 188 and can be connected with the drawing member 186.

The drawing member 186 can be respectively connected with the transmission part 184 and the actuator 112. The drawing member 186 can have an elongated shape, and can be made of a flexible material formed in a strip or band shape that can wind and unwind at least partially on the cylindrical shape of the transmission part 184. In one embodiment, the drawing member 186 can be a drawing cord having a first end affixed with the transmission part 184, and a second end connected with the actuator 112. A downward movement of the actuator 112 can be transmitted via the drawing member 186 to pull the transmission part 184 in rotation, which in turn causes the collar 182 to rotate owing to the engagement between the gear portion 188 and 182B for turning the arrester 132 from the locking state to the release state.

Referring to FIGS. 1, 2, 4 and 12, the actuator 112 can have an elongated shape that extends vertically downward from the head rail 102. The actuator 112 can be arranged at one side of the head rail 102, and can be operatively connected with the arrester 132 via the collar 182, the transmission part 184 and the drawing member 186. The actuator 112 can include an end connector assembly 112A and an elongated stick portion 112B. The stick portion 112B can be pivotally connected with the end connector assembly 112A, so that a user can easily incline the stick portion 112B relative to a vertical direction for facilitating its operation. The end connector assembly 112A can be connected with the second end of the drawing member 186, and mounted with the cover 144. Accordingly, the actuator 112 and the drawing member 186 can be movable in unison.

In one embodiment, the end connector assembly 112A can include a sliding frame 190 and a joint part 192. The sliding frame 190 can have a plate shape, and the joint part 192 can include a hollow cylindrical shape. The sliding frame 190 can be assembled with an extension 144A of the cover 144, and the joint part 192 can be respectively connected pivotally with the sliding frame 190 and the stick portion 112B about different pivot axes. The sliding frame 190, the joint part 192 and the stick portion 112B can move up and down in unison relative to the outer casing formed by the assembly of the housing 142 and the cover 144. Moreover, the joint part 192 and the stick portion 112B can rotate relative to sliding frame 190, the housing 142 and the cover 144 about a lengthwise axis Y defined along the stick portion 112B. For pivotally assembling the sliding frame 190 with the joint part 192, one embodiment can provide a curved portion 190A at one end of the sliding frame 190, and the joint part 192 can include a slot 192A that complementarily mate with the shape of the curved portion 190A for pivotally connecting the sliding frame 190 with the joint part 192. Through the end connector assembly 112A, the stick portion 112B can rotate about the lengthwise axis Y, and move up and down along the lengthwise axis Y relative to the outer casing formed by the housing 142 and the cover 144.

The actuator 112 can be movable vertically between a first and a second position relative to the outer casing formed by the housing 142 and the cover 144. More particularly, the actuator 112 when in the first position can be coupled with the drive axle 109. As a result, rotation of the actuator 112 about the lengthwise axis Y can drive the drive axle 109 in rotation. When it moves downward from the first position to the second position, the actuator 112 can pull the drawing member 186 downward, which causes the transmission part 184 to rotate. Owing to the engagement between the gear portion 188 of the transmission part 184 and the gear portion 182B of the collar 182, the rotation of the transmission part 184 can drive the arrester 132 to the release state allowing rotation of the drive axle 108.

The actuator 112 can be coupled with the drive axle 109 via one or more transmission parts. In one embodiment, two transmission parts 194 and 195 can be pivotally assembled within the housing 142 for coupling the actuator 112 with the drive axle 109.

The transmission part 194 can have a hollow cylindrical shape, and can have a pivot axis that extends parallel along the sliding axis of the end connector assembly 122A relative to the housing 142 and the cover 144, which can be inclined an angle relative to a vertical axis. Moreover, the transmission part 194 can include an end portion that can move to couple with the joint part 192: for example, the transmission part 194 and the joint part 192 can include complementarily mating conical portions that can contact with each other in transition fit, or the transmission part 194 and the joint part 192 can include slotted and protrusion structures that can engage with each other. In the embodiment shown in FIG. 4, the joint part 192 can exemplary include an extension 192B having a radial rib, and the transmission part 194 can have an opening with an inner sidewall having a radial slot mating with the radial rib of the extension 192B. When the transmission part 194 is connected with the joint part 192, the rib on the extension 192B can engage with the radial slot of the transmission part 194, which rotationally locks the transmission part 194 with the joint part 192 while allowing the joint part 192 to slide up and down relative to the transmission part 194. With this construction, the joint part 192 can displace toward and away from the transmission part 194 when the actuator 112 respectively moves up and down.

The transmission part 195 can have a hollow cylindrical shape, and can have a pivot axis that extends parallel along the drive axle 109. The transmission part 195 can be affixed with the drive axle 109, and both the transmission part 195 and the drive axle 109 can rotate in unison about a same axis. The transmission parts 194 and 195 can engage with each other via a gear transmission 196. The gear transmission 196 can include a worm gear, a helicoid gear, a conical gear, and the like.

When the actuator 112 is in the first position, owing to the coupling between the joint part 192 and the transmission part 194, rotation of the actuator 112 about the lengthwise axis Y can drive the drive axle 109 in rotation via the transmission parts 194 and 195 and the gear transmission 196. The rotation of the drive axle 109 can be transmitted via the gears 126 and 128 and the intermediate gear 130 to the rotary part 124, which consequently rotates to drive vertical displacement of the corresponding ladder cord assembly 118 for adjusting the inclination of the slats 104.

The operating cord 110 can be routed through the transmission part 194 and along an interior of the actuator 112 (i.e., through the joint part 192 and the stick portion 112B). A lower end of the operating cord 110 can be affixed with a plug 197. When the operating cord 110 is moving upward, the plug 197 can abut against a lower end of the actuator 112 to prevent the operating cord 110 from sliding completely out of the actuator 112.

When the operating cord 110 is not manipulated by a user, the spring 180 can tighten around the sleeve 161 to block rotation of the drive axle 108. The slats 104 and the bottom part 106 can be thereby held at a stationary position by the locking action of the arrester 132. It is worth noting that the sleeve 161 can be formed as any part of various shapes that is assembled with the drive axle 108 and can operatively connect with the clutch, and should not be limited to elements mounted with the drive axle. In other embodiments, the sleeve 161 can also be formed integral with the drive axle 108, and the spring 180 can tighten on the drive axle 108 to block its rotation.

Moreover, while the actuator 112 is not pulled downward, a user can rotate the actuator 112 about the lengthwise axis Y. This rotation of the actuator 112 can be transmitted via the transmission parts 194 and 195, the drive axle 109, the gears 126 and 128 and the intermediate gear 130 to drive the rotary part 124 in rotational displacement. As a result, the associated ladder cord assembly 118 can move vertically to adjust the inclination of the slats 104.

Figure 14:
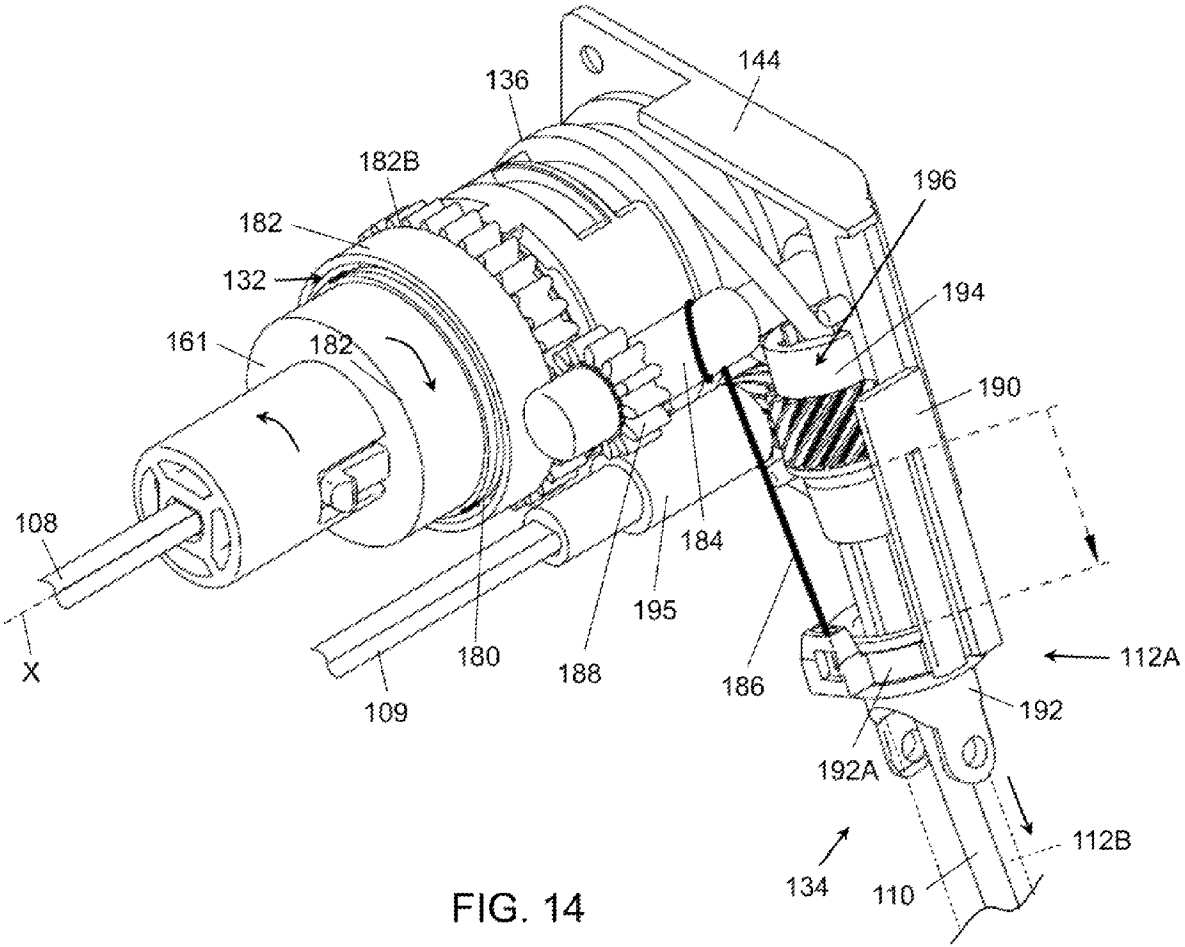
FIG. 14 is a schematic view illustrating an operation of the release unit.
Figure 15:
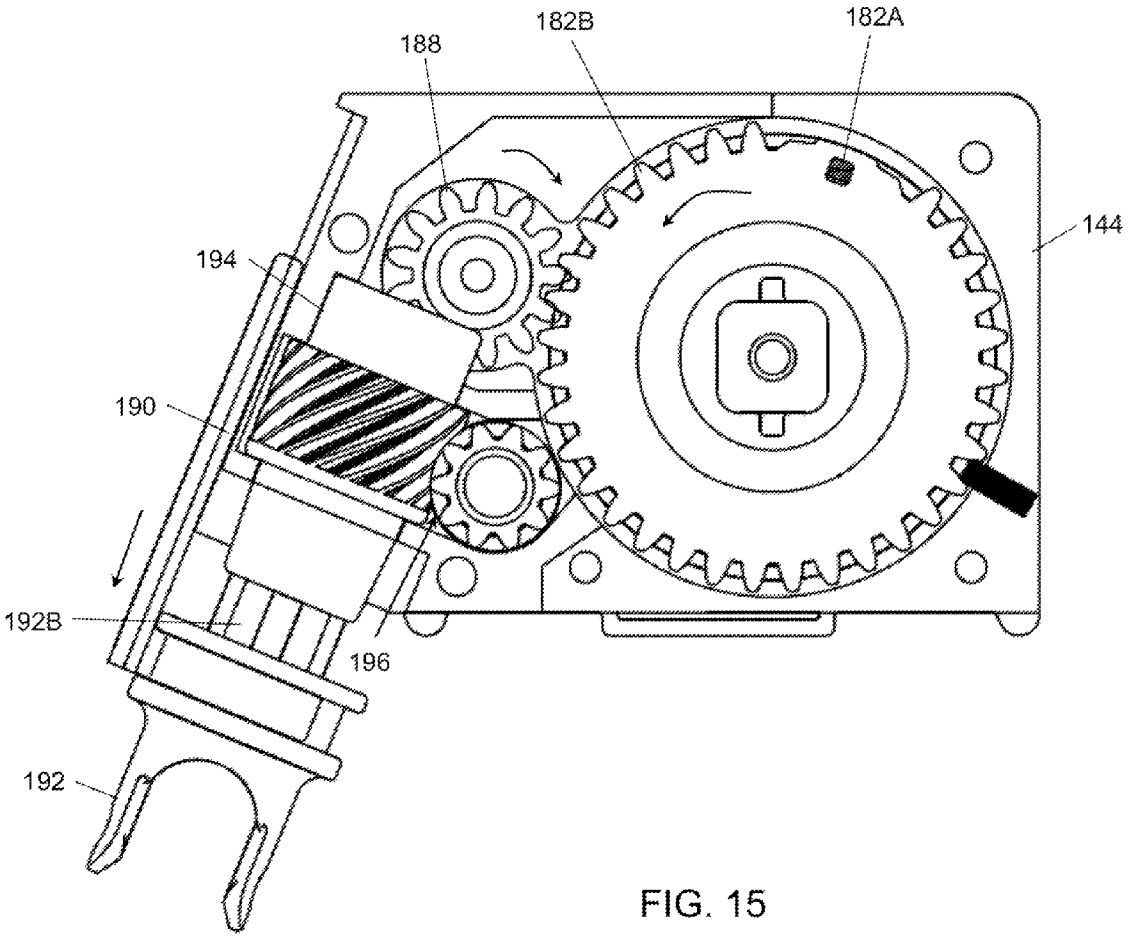
FIG. 15 is a side view illustrating an operation of the release unit.
Figure 16:
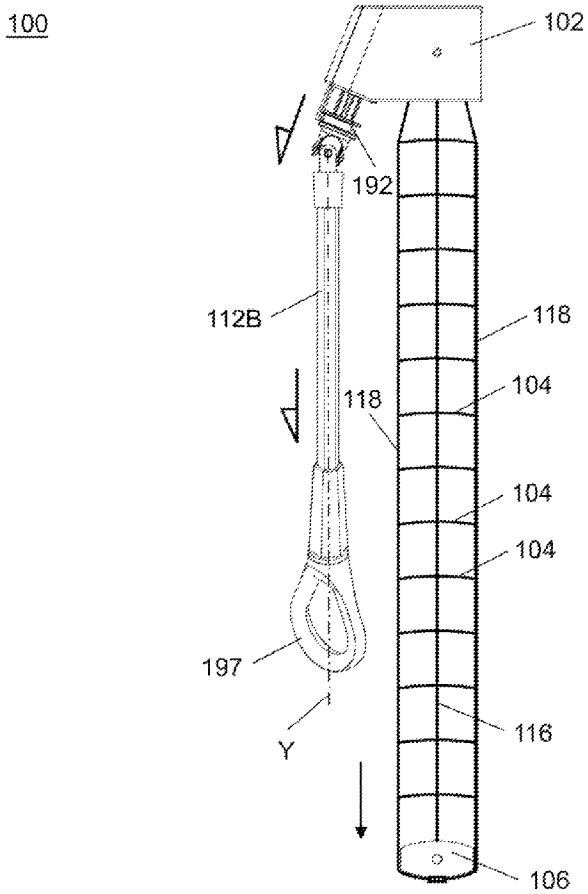
FIG. 16 is a schematic view illustrating an operation for lowering the window shade.

FIGS. 14-16 are schematic views illustrating the operation of the release unit 134. When a user wants to lower the bottom part 106, the actuator 112 can be gently pulled downward. As a result, the drawing member 186 can be pulled by the actuator 112 to drive the transmission part 184 in rotation, which in turn drives a rotational displacement of the collar 182 about the rotation axis X of the drive axle 108 owing to the engagement between the gear portions 188 and 182B. This rotation of the collar 182 can cause a displacement of the second prong 180B for loosening the spring 180. The arrester 132 can thereby turn from the locking state to the unlocking state. While the actuator 112 moves downward, the joint part 192 can also be driven to move away from the transmission part 194.

In conjunction with FIGS. 1-15, FIG. 16 is a schematic view illustrating an operation for lowering the window shade 100, and FIG. 17 is a schematic view illustrating a configuration of the guide track 164 in the clutch 138 when the window shade 100 is lowered. Once the arrester 132 is switched to its unlocking state, the total weight of the bottom part 106 and the slats 104 stacked thereon can pull the suspension cords 116 to respectively unwind from the winding drums 122 of the cord winding units 120, which can in turn cause the drive axle 108 to rotate relative to the cord drum 136. While the drive axle 108 and the sleeve 161 rotate for lowering the bottom part 106, the cord drum 136 can be kept stationary, and the rolling part 160 can roll and move along the radial slot 179 and the guide track 164 relative to the first and second couplings 150 and 152 and the sleeve 161, as shown by the arrow in FIG. 17. In particular, when the bottom part 106 is lowering, the spring 154 can produce frictional resistance to keep the first and second couplings 150 and 152 stationary, whereby the clutch 138 can be maintained in the decoupling state, i.e., no stop regions 177 are formed in the guide track 164. Moreover, when the clutch 138 is in the decoupling state, the radial rib 172 of the second coupling 152 is spaced apart from the radial abutment 168 which is located in one notch 165 of the first coupling 150.

Figure 18:
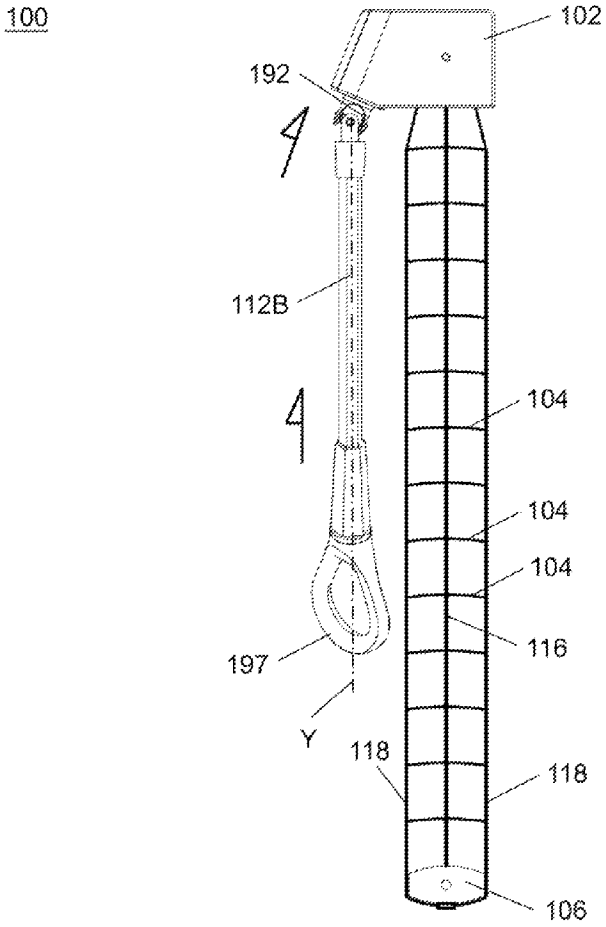
FIG. 18 is a schematic view illustrating the release of an actuator of the control module that is movable to recover an initial position once the window shade is adjusted to a desired height.

When the bottom part 106 moving downward reaches a desired height, the actuator 112 can be released. As a result, the spring 180 can elastically recover its tightening state around the sleeve 161, which can cause the arrester 132 to turn to the locking state to block rotation of the drive axle 108 and the sleeve 161. Accordingly, the bottom part 106 can be locked at the desired height. While the spring 180 is recovering its tightening state, the collar 182 can also rotate in an opposite direction, which can drive the transmission part 184 to rotate and partially wind the drawing member 186 owing to the engagement between the gear portions 182B and 188. Consequently, the tension exerted through the drawing member 186 can drive the actuator 112 to move upward, until the joint part 192 reaches the first position and abuts and couples with the transmission part 194, as shown in FIG. 18.

Figure 19:
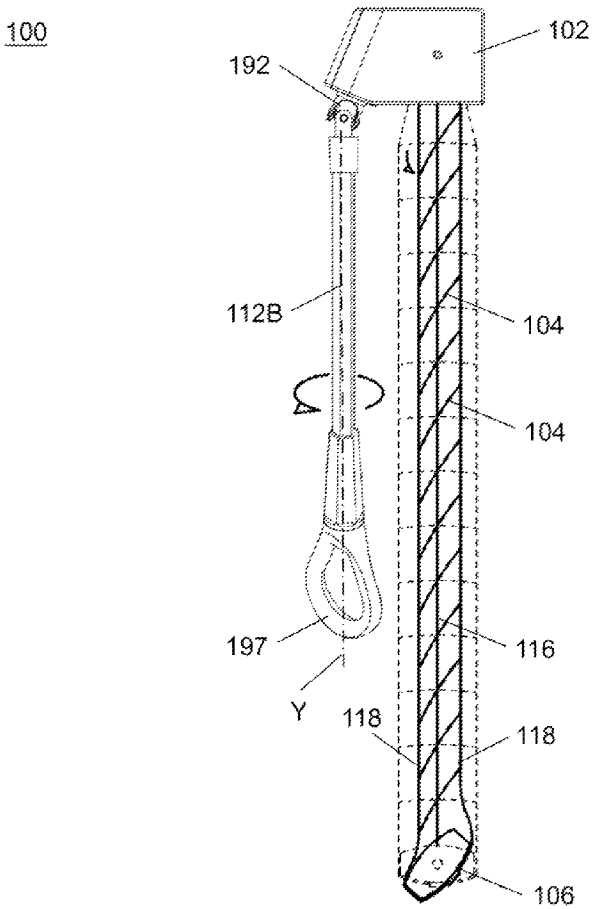
FIG. 19 is a schematic view illustrating an adjustment of the inclination of the slats in a first direction.
Figure 20:
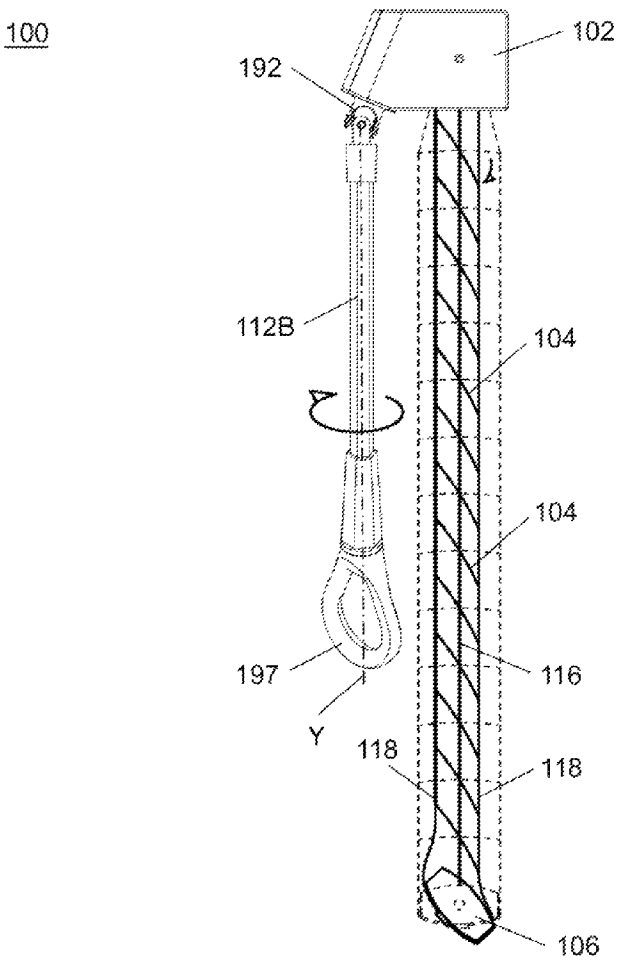
FIG. 20 is a schematic view illustrating an adjustment of the inclination of the slats in a second direction.

FIGS. 19 and 20 are schematic views illustrating the adjustment of the inclination of the slats 104. While the bottom part 106 is kept at a desired height, the stick portion 112B of the actuator 112 can be rotated about its lengthwise axis Y. This rotation of the stick portion 112B can be transmitted through the joint part 192 and the transmission part 194 coupled with each other, the transmission part 195, the drive axle 109, the gears 126 and 128 and the intermediate gear 130 to drive a rotational displacement of the rotary part 124, which in turn causes the ladder cord assembly 118 to move vertically to adjust the inclination of the slats 104.

Figure 21:
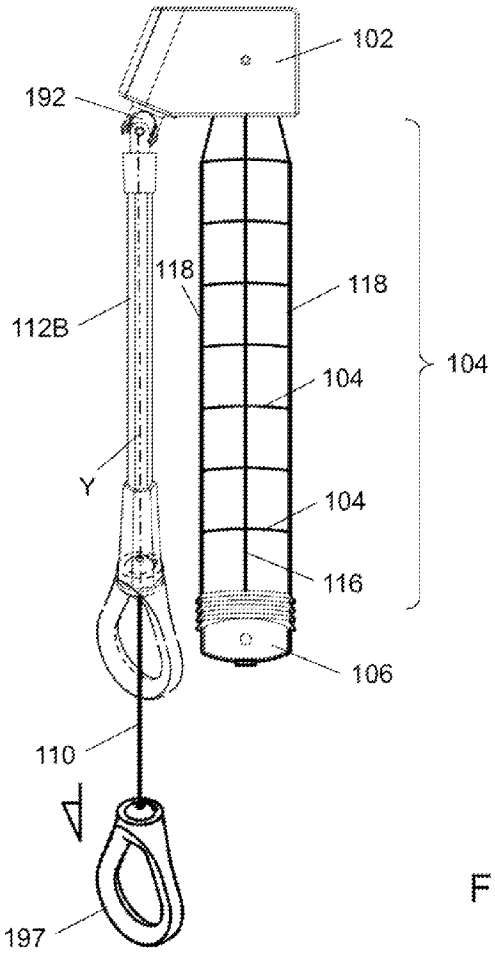
FIG. 21 is a schematic view illustrating an operating for raising the window shade.
Figure 22:
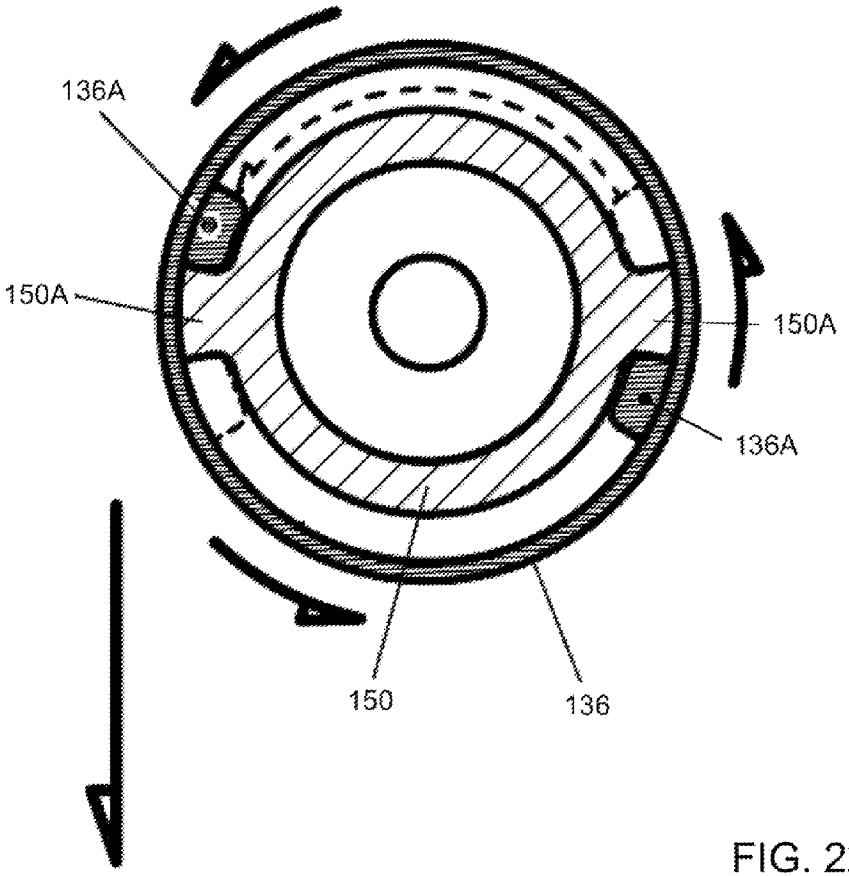
FIG. 22 is a partial cross-sectional view illustrating a configuration of a cord drum and first coupling in the control module when the window shade is raised.
Figure 23:
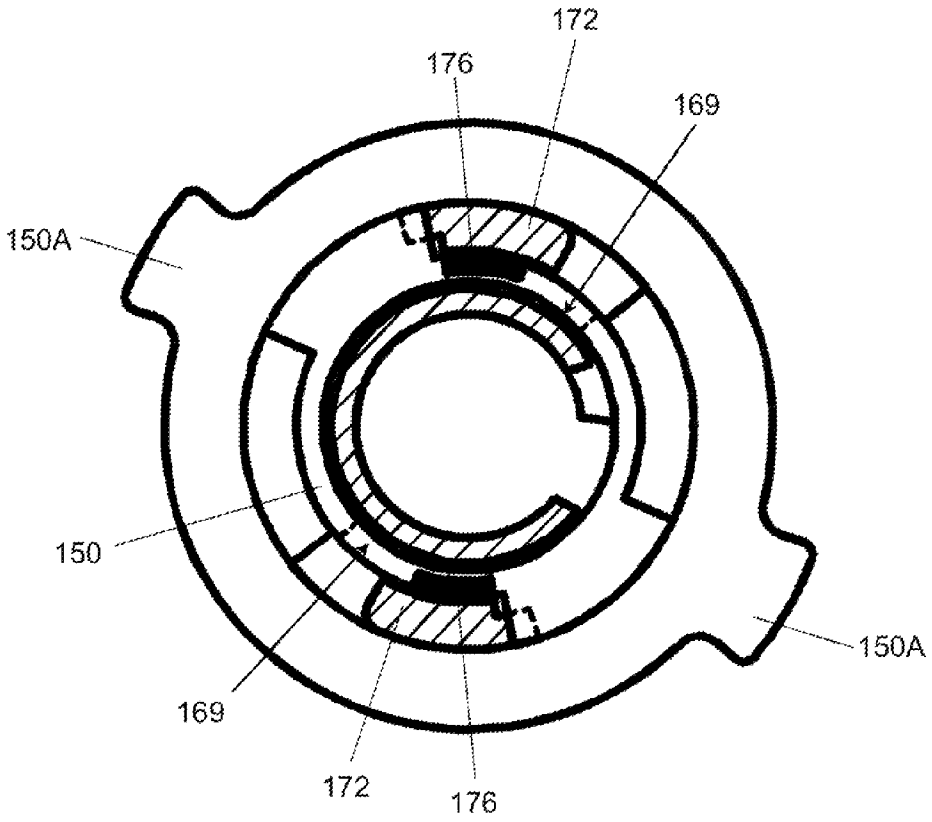
FIG. 23 is a partial cross-sectional view illustrating a configuration of a first and a second coupling in the control module when the window shade is raised.

FIGS. 21-25 are schematic views illustrating an operation for raising the window shade 100. Referring to FIG. 21, when a user wants to raise the bottom part 106, the operating cord 110 can be pulled downward, which causes the operating cord 110 to unwind from the cord drum 136 and travel through the interior of the actuator 112 which is kept generally stationary. As shown in FIG. 22, while the cord drum 136 rotates for unwinding the operating cord 110, the radial flange 136A of the cord drum 136 can push against one radial flange 150A of the first coupling 150. As a result, the first coupling 150 can rotate relative to the second coupling 152, until the radial abutment 168 of the first coupling 150 can contact with the radial rib 172 of the second coupling 152 (as better shown in FIG. 23). In this configuration, the second coupling 152 can be in a second position relative to the first coupling 150 where stop regions 177 are formed in the guide track 164 (as better shown in FIGS. 24 and 25).

While the operating cord 110 is continuously pulled downward, the cord drum 136 and the clutch 138 can rotate synchronously until the rolling part 160 reaches one stop region 177. It is worth noting that the illustrated embodiment can form two stop regions 177 in the guide track 164 so as to shorten the course of the rolling part 160 to the next stop region 177. However, alternate embodiments can also have the guide track 164 formed with a single stop region 177.

When the rolling part 160 reaches one stop region 177, the clutch 138 can be turned to the coupling state. Since the rolling part 160 concurrently engages with the stop region 177 and the radial slot 179 of the sleeve 161, further downward pulling on the operating cord 110 can drive the cord drum 136 in rotation. Owing to the contact between the radial flanges 136A and 150A, the rotation of the cord drum 136 can be transmitted to the clutch 138, which in turn can transmit the rotation to the sleeve 161 and the drive axle 108 via the engagement of the rolling part 160 with the radial slot 179 of the sleeve 161 and the stop region 177 of the clutch 138. As the sleeve 161 rotates, the first prong 180A of the spring 180 can abut against an inner surface of the housing 142, which can cause the spring 180 to switch from the state tightening on the sleeve 161 to the loosening state and have the arrester 132 turned to a release state. Accordingly, by pulling the operating cord 110 downward, the clutch 138 can be switched to the coupling state in which rotational displacement can be transmitted through the clutch 138 to drive the cord drum 136, the sleeve 161 and the drive axle 108 in synchronous rotation for raising the bottom part 106.

While the bottom part 106 is moving upward, the user can release the operating cord 110 at any time, e.g., when the bottom part 106 reaches a desired height or after the operating cord 110 has been entirely unwound from the cord drum 136. When the operating cord 110 is released, the spring 180 can recover its tightening state around the sleeve 161. The tightening action of the spring 180 can lock and block movement of the sleeve 161 and the drive axle 108, whereby the slats 104 and the bottom part 106 can be held at the desired height. At the same time, the spring 140 can reversely rotate the cord drum 136 to wind the operating cord 110 thereon.

Figure 26:
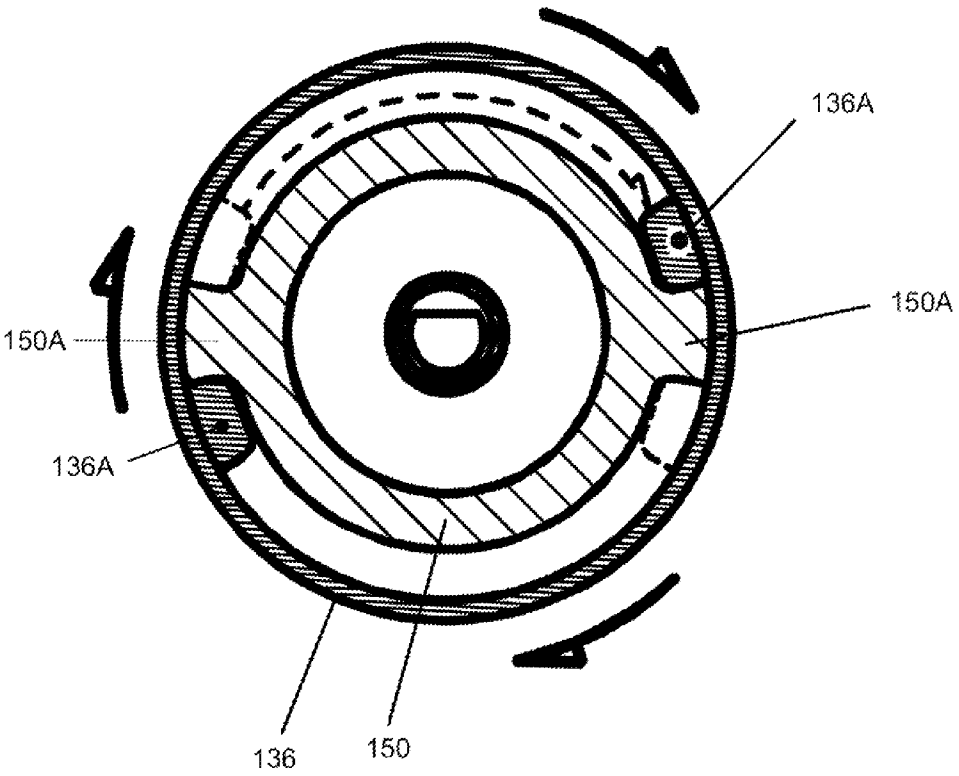
FIG. 26 is a partial cross-sectional view illustrating a first coupling and a cord drum in the control module during winding of the operating cord.

Referring to FIG. 26, while the cord drum 136 rotates reversely, the radial flange 136A of the cord drum 136 can contact and push against the opposing radial flange 150A of the first coupling 150, whereby the first coupling 150 can be synchronously driven to rotate relative to the second coupling 152.

Figure 27:
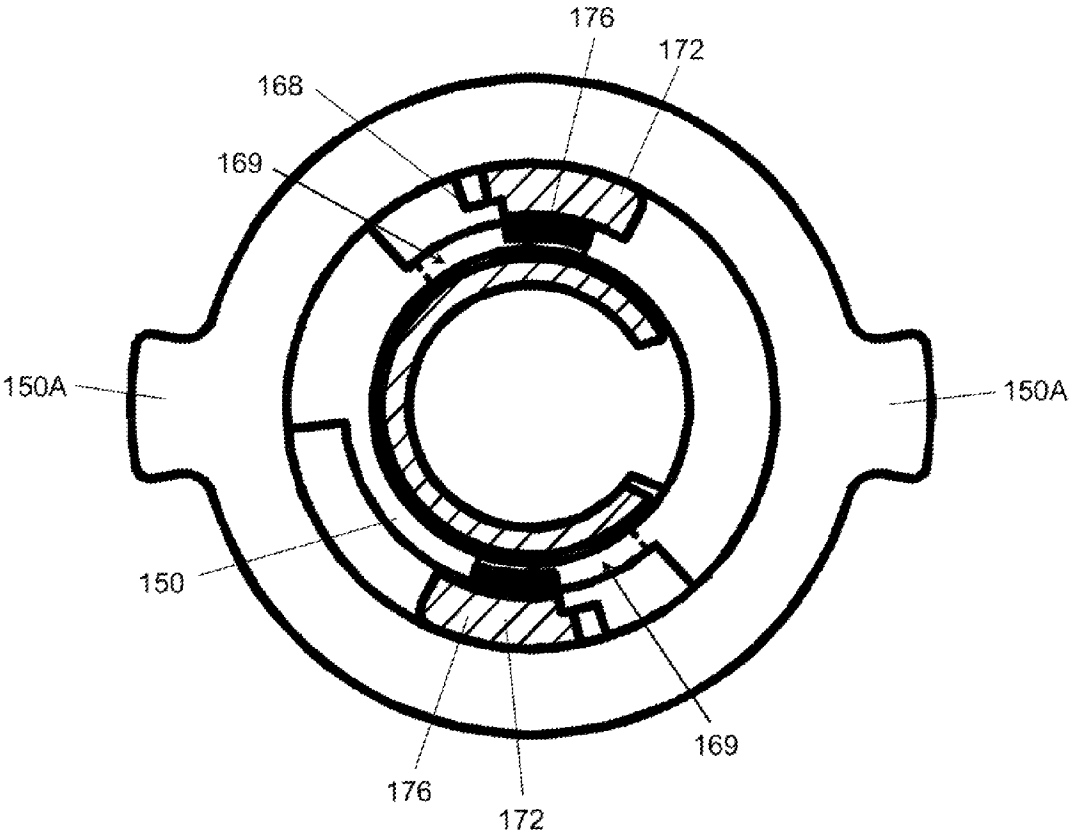
FIG. 27 is a partial cross-sectional view illustrating a first and a second coupling in the control module when the cord drum is winding the operating cord.
Figure 28:
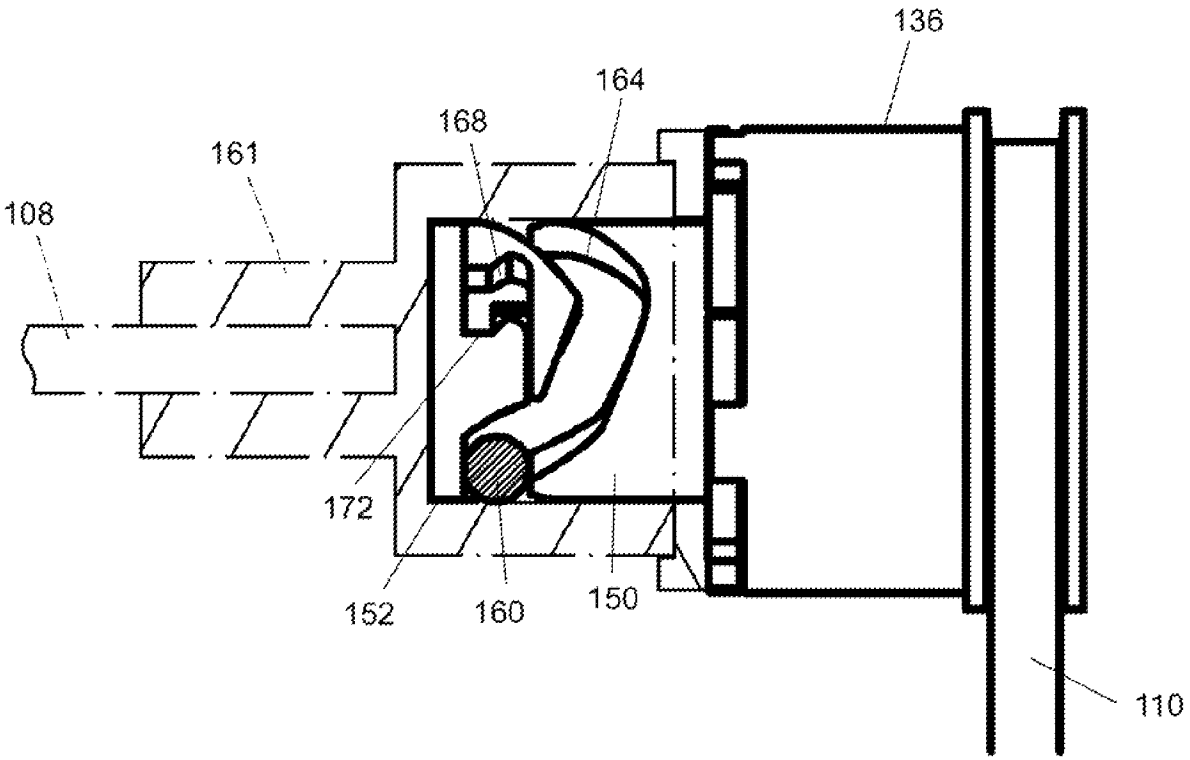
FIG. 28 is a schematic view illustrating a portion of the control module when the cord drum is winding the operating cord.
Figure 29:
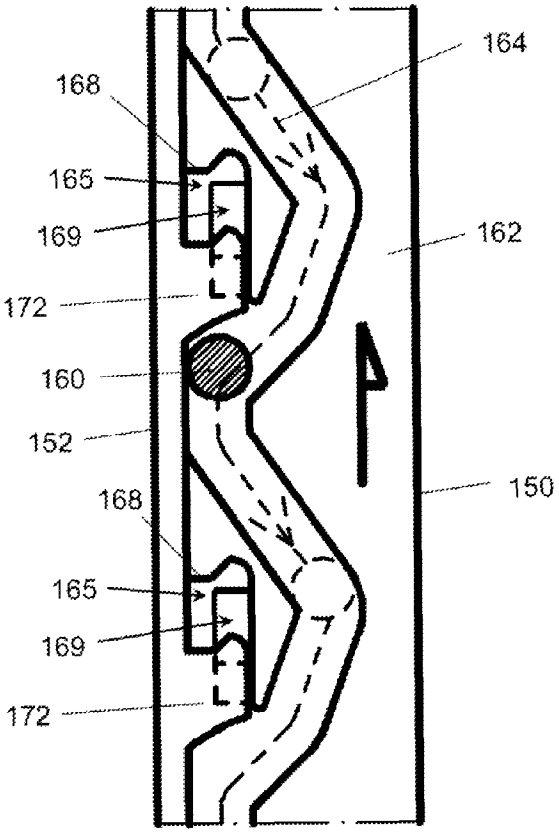
FIG. 29 is a schematic view illustrating a configuration of a guide track provided in the clutch when the cord drum is winding the operating cord.

Referring to FIGS. 27-29, the rotation of the first coupling 150 and the cord drum 136 can result in each radial abutment 168 of the first coupling 150 to move away from the radial rib 172 adjacent thereto, until the first coupling 150 reaches another abuttal position where no stop regions 177 are formed in the guide track 164 (as shown in FIGS. 28 and 29). Once the extension 176 (better shown in FIG. 7)abuts against a side edge 169A of the slot 169 (the side edge 169A is better shown in FIG. 6), the guide track 164 can recover a configuration having no stop regions 177, and the clutch 138 can be turned to the decoupling state. Accordingly, the spring 140 can continue driving the cord drum 136 to rotate reversely for winding the operating cord 110, whereas the first and second couplings 150 and 152 can rotate in unison. Because no stop regions 177 are formed in the guide track 164, the coupled rotation of the first and second couplings 150 and 152 can cause the rolling part 160 to move along the guide track 164 and the radial slot 179 of the sleeve 161. While the first and second couplings 150 and 152 and the cord drum 136 rotate to wind the operating cord 110, the sleeve 161 and the drive axle 108 can be kept in a stationary state owing to the locking action exerted by the spring 180. Therefore, the bottom part 106 and the salts 104 can be respectively kept in their current position while the cord drum 136 is winding the operating cord 110. After the cord drum 136 has wound partially or entirely the operating cord 110 (the plug 192 can abut against a lower end of the actuator 112 when the cord drum 136 entirely winds the operating cord 110), the user can pull the operating cord 110 downward again to raise the bottom part 106 and stack up the slats 104. The aforementioned operating steps can be repeated multiple times until the bottom part 106 and the slats 104 reach a desirable height.

It is worth noting that the functions and operations of the release unit 134 and the actuator 112 described previously can be implemented with various embodiments of the control module. In some variant embodiments, the release unit 134 and the actuator 112 may be implemented in a control module that has a different construction of the clutch. For example, the clutch may have one coupling, the sleeve can have a gear portion, and the clutch can switch between the coupling and decoupling state by having the coupling movable along the axis of the drive axle 108 to engage with and disengage from the sleeve.

With the structures and operating methods described herein, an elongated actuator can be provided to facilitate the operation of the window shade. The actuator can be pulled downward to turn the arrester of the control module from the locking state to the release state, whereby the window shade can self lower by gravity action. Moreover, the actuator can be rotated about its lengthwise axis to adjust an inclination of the slats in the window shade. Accordingly, the control module described herein has an actuator that can provide multiple adjustment functions, and can be convenient to operate.

Realizations of the structures and methods have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A control module of a window shade comprising:

an outer casing;

a first drive axle and a second drive axle, the first drive axle being operable to control vertical movement of a bottom part of the window shade, and the second drive axle being operable to adjust an inclination of multiple slats of the window shade;

a sleeve affixed with the first drive axle;

a transmission part connected with the second drive axle;

an arrester assembled around the first drive axle, the arrester having a locking state in which the arrester blocks a rotational displacement of the sleeve and the first drive axle to keep the bottom part at a desired position, and an unlocking state in which rotation of the sleeve and the first drive axle is allowed so that the bottom part lowers by gravity action; and a release unit including an actuator, the actuator being operatively connected with the arrester and including a stick portion and an end connector arranged near the outer casing, the stick portion having an elongated shape extending substantially vertically that defines a lengthwise axis, the end connector being assembled with the outer casing to allow the stick portion to rotate about the lengthwise axis and move up and down relative to the outer casing, the end connector including a joint part connected with the stick portion;

wherein the actuator is operable to move downward from a first position to a second position to turn the arrester from the locking state to the unlocking state, the joint part being coupled with the transmission part and rotatable with the stick portion to drive the second drive axle in rotation while the actuator is in the first position, and the joint part being displaced away from the transmission part by a downward displacement of the stick portion when the actuator is switched from the first position to the second position.

2. The control module according to claim 1, wherein the stick portion and the joint part are operatively connected with the second drive axle via the transmission part when the actuator is in the first position.

3. The control module according to claim 1, wherein the actuator when moving from the second position to the first position causes the joint part to move toward the transmission part.

4. The control module according to claim 1, wherein the transmission part is operatively connected with the second drive axle via a gear transmission.

5. The control module according to claim 4, wherein the gear transmission includes a worm gear, a helicoid gear, or a conical gear.

6. The control module according to claim 1, wherein the end connector further includes a sliding frame, the joint part is pivotally assembled with the sliding frame and is movable to couple with the transmission part, and the sliding frame is movable relative to the outer casing to drive displacement of the joint part away from or toward the transmission part.

7. The control module according to claim 1, further comprising:

a cord drum;

an operating cord connected with the cord drum, the operating cord passing through the joint part and the stick portion; and a clutch connected with the arrester and the cord drum;

wherein a pulling action on the operating cord drives the cord drum to rotate and turns the clutch to a coupling state, such that a rotation of the cord drum is transmitted through the clutch in the coupling state to drive the sleeve and the first drive axle in rotation.

8. The control module according to claim 7, wherein the arrester includes a spring assembled around the sleeve, the spring tightening on the sleeve in the locking state, the spring loosening in the unlocking state, and a pulling action on the operating cord causes the spring to turn to the unlocking state.

9. The control module according to claim 1, wherein the arrester includes a spring assembled around the sleeve, the spring tightening on the sleeve in the locking state, and the spring loosening in the unlocking state.

10. The control module according to claim 1, wherein the first drive axle is parallel to the second drive axle.

11. A window shade comprising:

a head rail;

a plurality of slats;

a bottom part disposed below the slats;

at least one cord winding unit including a housing, and a winding drum and a rotary part respectively assembled pivotally in the housing;

at least one suspension cord and a ladder cord assembly, the suspension cord being connected with the winding drum and the bottom part, and the ladder cord assembly being connected with the rotary part, the slats and the bottom part; and the control module according to claim 1, the control module being assembled in the head rail at a location spaced apart from the cord winding unit, wherein the first drive axle of the control module is connected with the winding drum, and the second drive axle of the control module is connected with the rotary part.

12. The control module according to claim 1, wherein the joint part is pivotally connected with the stick portion, the stick portion being pivoted relative to the joint part to adjust a tilt angle of the stick portion relative to a vertical direction.

13. The control module according to claim 1, wherein the stick portion has a hollow interior, and the joint part is arranged outside the interior of the stick portion.

14. A control module of a window shade, comprising:

a first drive axle and a second drive axle, the first drive axle being operable to control vertical movement of a bottom part of the window shade, and the second drive axle being operable to adjust an inclination of multiple slats of the window shade;

a sleeve affixed with the first drive axle;

a first transmission part connected with the second drive axle;

an arrester assembled around the first drive axle, the arrester having a locking state in which the arrester blocks a rotational displacement of the sleeve and the first drive axle to keep the bottom part at a desired position, and an unlocking state in which rotation of the sleeve and the first drive axle is allowed so that the bottom part lowers by gravity action, the arrester including a spring assembled around the sleeve, the spring tightening on the sleeve in the locking state, and the spring loosening in the unlocking state; and a release unit including an actuator, a collar, a second transmission part and a drawing member, the actuator being operatively connected with the arrester and having an elongated shape extending substantially vertical, the collar being operable to rotate around a rotation axis of the first drive axle, the second transmission part being engaged with the collar, and the drawing member being respectively connected with the second transmission part and the actuator;

wherein the actuator is operable to move downward from a first position to a second position to turn the arrester from the locking state to the unlocking state, and the actuator when in the first position is coupled with the first transmission part and is operable to drive the second drive axle in rotation; and wherein a downward displacement of the actuator to the second position pulls on the drawing member that drives rotation of the second transmission part in a first direction, and the rotation of the second transmission part in the first direction drives a rotational displacement of the collar about the rotation axis of the first drive axle to cause the spring to loosen.

15. The control module according to claim 14, wherein the drawing member is a drawing cord, the drawing cord partially winding around the second transmission part when the second transmission part rotates in a second direction opposite to the first direction thereon, and the drawing cord unwinding from the second transmission part when the second transmission part rotates in the first direction.

16. The control module according to claim 14, wherein the arrester is a wrapping spring having first and second prongs, the first prong being connected with a housing of the control module, and the second prong being connected with the collar.

17. The control module according to claim 14, further comprising:

a cord drum;

an operating cord connected with the cord drum and passing through an interior of the actuator; and a clutch arranged between the arrester and the cord drum;

wherein a pulling action on the operating cord drives the cord drum to rotate and turns the clutch to a coupling state, such that the rotation of the cord drum is transmitted through the clutch in the coupling state to drive the sleeve and the first drive axle in rotation.

18. The control module according to claim 14, wherein the collar is connected with the second transmission part through a gear engagement.

19. A window shade comprising:

a head rail, a plurality of slats, and a bottom part disposed below the slats;

at least one cord winding unit including a housing, and a winding drum and a rotary part respectively assembled pivotally in the housing;

at least one suspension cord and a ladder cord assembly, the suspension cord being connected with the winding drum and the bottom part, and the ladder cord assembly being connected with the rotary part, the slats and the bottom part;

a control module assembled in the head rail at a location spaced apart from the cord winding unit, wherein the control module includes:

a first drive axle connected with the winding drum, and a second drive axle connected with the rotary part, the first drive axle being operable to control vertical movement of a bottom part of the window shade, the second drive axle being and operable to adjust an inclination of multiple slats of the window shade, and the winding drum and the rotary part being disposed coaxial around the first drive axle, the rotary part being operable to rotate relative to the winding drum;

a sleeve affixed with the first drive axle;

a transmission part connected with the second drive axle;

an arrester assembled around the first drive axle, the arrester having a locking state in which the arrester blocks a rotational displacement of the sleeve and the first drive axle to keep the bottom part at a desired position, and an unlocking state in which rotation of the sleeve and the first drive axle is allowed so that the bottom part lowers by gravity action; and a release unit including an actuator, the actuator being operatively connected with the arrester and having an elongated shape extending substantially vertical;

wherein the actuator is operable to move downward from a first position to a second position to turn the arrester from the locking state to the unlocking state, and the actuator when in the first position is operable to drive the second drive axle in rotation via a coupling between the actuator and the transmission part.

20. The window shade according to claim 19, wherein the second drive axle is operatively connected with the rotary part via a plurality of gears.

* * * * *